US008191761B2

(12) United States Patent
Brand

(10) Patent No.: US 8,191,761 B2
(45) Date of Patent: Jun. 5, 2012

(54) COOLER BOX WITH HANDLE

(75) Inventor: Kirsten L. Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 258 days.

(21) Appl. No.: 12/608,644

(22) Filed: Oct. 29, 2009

(65) Prior Publication Data

US 2010/0108747 A1 May 6, 2010

Related U.S. Application Data

(60) Provisional application No. 61/109,648, filed on Oct. 30, 2008.

(51) Int. Cl.
*B65D 5/46* (2006.01)
*B65D 65/28* (2006.01)

(52) U.S. Cl. ..... 229/117.12; 428/43

(58) Field of Classification Search ..... 229/117.12, 229/117.3, 117.17, 208, 221, 200; 220/592.17; 62/457.5

See application file for complete search history.

(56) References Cited

U.S. PATENT DOCUMENTS

| | | | |
|---|---|---|---|
| 1,253,193 | A | 1/1918 | Hill |
| 2,383,183 | A | 8/1945 | Fischer |
| 2,594,376 | A | 4/1952 | Arneson |
| 2,702,144 | A | 2/1955 | Forrer |
| 2,797,856 | A | 7/1957 | Jaeschke |
| 2,810,506 | A | 10/1957 | Kessler |
| 2,819,506 | A | 10/1957 | Kessler |
| 2,868,433 | A | 1/1959 | Anderson, Jr. |
| 2,955,739 | A | 10/1960 | Collura |
| 3,112,856 | A | 12/1963 | MacIntosh et al. |
| 3,127,720 | A | 4/1964 | Gentry et al. |
| 3,204,814 | A | 9/1965 | Mahon |
| 3,204,815 | A | 9/1965 | Weis |
| 3,309,005 | A | 3/1967 | Pilger |
| 3,334,767 | A | 8/1967 | Cornelius et al. |
| 3,355,012 | A | 11/1967 | Weiss |
| 3,381,881 | A | 5/1968 | Granz et al. |
| 3,828,926 | A | 8/1974 | Rossi |

(Continued)

FOREIGN PATENT DOCUMENTS

| | | |
|---|---|---|
| CA | 877792 | 8/1971 |

(Continued)

OTHER PUBLICATIONS

International Search Report and Written Opinion for related PCT application, No. PCT/US2009/062477, mailed Jun. 22, 2010.
International Search Report for PCT application No. PCT/US2010/025178, mailed Sep. 2, 2010.

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A carton for holding containers is disclosed. The carton can be converted from a first configuration for storing and shipping containers therein to a second configuration in which the carton forms an open-top cooler for chilling and serving the containers. According to an embodiment, a handle is formed in a top panel and end panels of the carton in the first configuration. Conversion of the carton from the first configuration to the second configuration can be accomplished by detaching the handle from the top panel and folding open portions of the top panel and end panels.

35 Claims, 19 Drawing Sheets

U.S. PATENT DOCUMENTS 3,886,901 A 6/1975 Zeitler
3,894,681 A 7/1975 Arneson et al.
3,904,036 A 9/1975 Forrer
3,933,303 A 1/1976 Kirby, Jr.
3,994,432 A 11/1976 Kirby, Jr.
4,029,204 A 6/1977 Manizza
4,036,423 A 7/1977 Gordon
4,096,985 A 6/1978 Wood
4,111,306 A 9/1978 Roccaforte
4,216,861 A 8/1980 Oliff
4,318,474 A 3/1982 Hasegawa
4,328,923 A 5/1982 Graser
4,329,923 A 5/1982 Iida
4,331,289 A 5/1982 Killy
4,364,509 A 12/1982 Holley et al.
4,375,258 A 3/1983 Crayne et al.
4,378,905 A 4/1983 Roccaforte
4,382,505 A 5/1983 Sutherland et al.
4,396,143 A 8/1983 Killy
4,418,864 A * 12/1983 Nielsen ..... 229/117.13
4,424,901 A 1/1984 Lanier
4,440,340 A 4/1984 Bakx
4,478,334 A 10/1984 Graser
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,577,799 A 3/1986 Oliff
4,588,084 A 5/1986 Holley, Jr.
4,653,686 A 3/1987 Wood et al.
4,706,876 A 11/1987 Wilson
4,747,487 A 5/1988 Wood
4,784,266 A 11/1988 Chaussadas
4,784,316 A 11/1988 Crouch
4,802,583 A 2/1989 Calvert et al.
4,830,267 A 5/1989 Wilson
4,875,586 A 10/1989 Chaussadas
4,966,324 A 10/1990 Steel
5,020,337 A 6/1991 Krieg
5,060,792 A 10/1991 Oliff
5,072,876 A 12/1991 Wilson
5,094,359 A 3/1992 DeMars et al.
5,106,014 A 4/1992 Miller
5,119,985 A 6/1992 Dawson et al.
5,197,598 A 3/1993 Stout et al.
5,221,041 A 6/1993 Stout et al.
5,222,658 A 6/1993 DeMaio et al.
5,234,102 A 8/1993 Schuster et al.
5,246,112 A 9/1993 Stout et al.
5,284,294 A 2/1994 Floyd
5,292,058 A 3/1994 Zoss et al.
5,297,725 A 3/1994 Sutherland
5,303,863 A 4/1994 Arasim
5,307,932 A 5/1994 Stout et al.
5,307,986 A 5/1994 Schuster
5,320,277 A 6/1994 Stout et al.
5,328,081 A 7/1994 Saulas
5,333,734 A 8/1994 Stout et al.
D350,480 S 9/1994 Sutherland
5,379,944 A 1/1995 Stout et al.
5,381,891 A 1/1995 Harris
5,385,234 A 1/1995 Stout et al.
5,395,044 A 3/1995 Stout
5,427,241 A 6/1995 Sutherland
5,458,234 A 10/1995 Harris
5,472,090 A 12/1995 Sutherland
5,485,915 A 1/1996 Harris
5,495,727 A 3/1996 Strong et al.
5,524,756 A 6/1996 Sutherland
5,551,556 A 9/1996 Sutherland
5,582,343 A 12/1996 Dalvey
5,639,017 A 6/1997 Fogle
5,647,483 A 7/1997 Harris
5,669,500 A 9/1997 Sutherland
5,699,957 A 12/1997 Bin et al.
5,704,470 A 1/1998 Sutherland
5,738,273 A 4/1998 Auclair
5,739,273 A 4/1998 Engelman et al.
5,794,778 A 8/1998 Harris
5,796,778 A 8/1998 Kurker
5,826,782 A 10/1998 Stout
5,873,515 A 2/1999 Dunn et al.
5,878,946 A 3/1999 Frerot et al.
5,906,313 A 5/1999 Oliff
5,915,546 A 6/1999 Harrelson
5,992,733 A 11/1999 Gomes
6,019,276 A 2/2000 Auclair
6,021,897 A 2/2000 Sutherland
6,065,590 A 5/2000 Spivey
6,085,969 A 7/2000 Burgoyne
6,105,853 A 8/2000 Lamare
6,105,854 A 8/2000 Spivey et al.
6,112,977 A 9/2000 Sutherland et al.
6,129,266 A 10/2000 Oliff et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,260,755 B1 7/2001 Bates et al.
6,302,320 B1 10/2001 Stout
D452,154 S 12/2001 Rhodes et al.
6,425,520 B1 7/2002 Peterson
6,523,739 B2 2/2003 Heeley et al.
6,536,656 B2 3/2003 Auclair et al.
6,631,803 B2 10/2003 Rhodes et al.
6,758,337 B2 7/2004 Chargueraud et al.
6,766,940 B2 7/2004 Negelen
6,834,793 B2 12/2004 Sutherland
6,848,573 B2 2/2005 Gould et al.
6,869,009 B2 3/2005 Sutherland et al.
6,905,066 B2 6/2005 Holley et al.
6,926,193 B2 8/2005 Smalley
6,945,450 B2 9/2005 Rusnock
6,968,992 B2 11/2005 Schuster
7,234,596 B2 6/2007 Lebras
7,296,731 B2 11/2007 Auclair et al.
7,380,701 B2 6/2008 Fogle et al.
7,416,109 B2 8/2008 Sutherland
7,427,010 B2 9/2008 Sutherland
7,472,791 B2 1/2009 Spivey, Sr.
7,601,111 B2 10/2009 Sutherland et al.
7,699,215 B2 4/2010 Spivey, Sr.
7,743,944 B2 6/2010 Ho Fung et al.
7,743,968 B2 6/2010 Theelen
7,748,603 B2 7/2010 Fogle et al.
7,757,933 B2 7/2010 Dunn
7,793,779 B2 9/2010 Spivey, Sr. et al.
7,806,314 B2 10/2010 Sutherland
2003/0213263 A1 11/2003 Woog
2004/0050917 A1* 3/2004 Smalley ..... 229/117.12
2004/0074954 A1 4/2004 Fogle et al.
2005/0056658 A1 3/2005 Spivey
2005/0087592 A1 4/2005 Schuster
2005/0167478 A1 8/2005 Holley, Jr.
2006/0071058 A1 4/2006 Spivey, Sr.
2006/0169755 A1 8/2006 Spivey, Sr.
2006/0273143 A1 12/2006 Finch
2007/0039846 A1 2/2007 Spivey, Sr.
2007/0051781 A1 3/2007 Holley, Jr.
2007/0108261 A1 5/2007 Schuster
2007/0164091 A1 7/2007 Fogle et al.
2007/0181658 A1 8/2007 Sutherland
2007/0205255 A1 9/2007 Dunn
2007/0284424 A1 12/2007 Holley
2007/0295789 A1 12/2007 Ho Fung
2008/0083820 A1 4/2008 Walling et al.
2008/0099544 A1* 5/2008 Skolik ..... 229/117.13
2008/0119344 A1 5/2008 Sutherland et al.
2009/0236408 A1 9/2009 Spivey, Sr.
2009/0255983 A1 10/2009 De Paula et al.
2010/0213249 A1 8/2010 Requena

FOREIGN PATENT DOCUMENTS

CA 2 160 145 9/1995
DE 85 14 718.4 6/1985
DE 296 07 374 U1 4/1996

| | | | |
|---|---|---|---|
| DE | 201 12 228 | | 11/2002 |
| DE | 2004 018 649 | | 4/2005 |
| EP | 0 412 226 | A1 | 2/1991 |
| EP | 0473 266 | | 3/1992 |
| EP | 1 612 157 | | 1/2006 |
| FR | 1 494 239 | | 9/1967 |
| FR | 2 579 175 | | 9/1986 |
| JP | 06-032320 | U | 4/1994 |
| KR | 20-0356729 | Y1 | 7/2004 |
| WO | WO/96/27538 | | 9/1996 |
| WO | WO 99/28207 | | 6/1999 |
| WO | WO/00/78618 | | 12/2000 |
| WO | WO/01/66434 | | 9/2001 |
| WO | WO/03/037742 | | 5/2003 |
| WO | WO/2005/080218 | | 9/2005 |
| WO | WO/2005/123532 | | 12/2005 |
| WO | WO/2007/089282 | | 8/2007 |

OTHER PUBLICATIONS

Written Opinion for PCT application No. PCT/US US2010/025178, mailed Sep. 2, 2010.

PCT/US2009/037642—International Search Report and Written Opinion Mar. 19, 2009.

International Search Report for related PCT application No. PCT/US2010/025177, mailed Sep. 2, 2010.

Written Opinion for related PCT application No. PCT/US2010/025177, mailed Sep. 2, 2010.

International Search Report and Written Opinion—PCT/US2009/040424, mailed Nov. 26, 2009.

Extended European Search Report for EP 09 82 7965 dated Feb. 22, 2012.

* cited by examiner

COOLER BOX WITH HANDLE

CROSS-REFERENCE TO RELATED APPLICATIONS

This application claims the benefit of U.S. Provisional Application No. 60/109,648, filed Oct. 30, 2008, the entire disclosure of which is incorporated herein by reference.

BACKGROUND

It is often desirable to serve a large quantity of containers, such as beverage and foodstuff containers, in a chilled condition. It may be desirable or necessary to chill such containers at locations or events for which there is little or no access to refrigerators or freezers, or at events for which it is not desirable to use refrigerators or freezers. For example, a large quantity of beverage and foodstuff containers may be served at parties, cookouts, picnics or vacation spots where it is desired to chill the containers for an extended period of time. In such cases, it is customary to place the containers in a cooler containing ice, which often requires the containers to be removed from their original packaging. In some cases, it would be advantageous to be able to chill containers in their original packaging without having to provide a separate cooler.

In view of the above, it is desirable to provide a carton that is convertible from a first configuration for holding containers during storage and/or transport to a second configuration in which the carton forms a cooler configured to receive ice for chilling and serving the containers.

SUMMARY

The disclosure is directed to a carton suitable for holding a plurality of containers and convertible to a configuration suitable for functioning as a cooler.

According to an embodiment, a carton can be converted from a first configuration, in which the carton is a substantially parallelepipedal structure, to a second configuration, in which the carton forms an open-top structure. When the carton is in the first configuration, the carton can comprise a first side panel, a second side panel opposite the first side panel, a bottom panel, a top panel, a first end panel, and a second end panel opposite the first end panel. The top panel can comprise a first outer top panel section foldably connected to the first side panel, a second outer top panel section foldably connected to the second side panel, and at least one central top panel section extending between and detachably connected to the first outer top panel section and the second outer top panel section. When the carton is in the second configuration, the at least one central top panel section is detached from the first outer top panel section and the second outer top panel section and forms a handle configured for carrying the carton. In the second configuration, the first outer top panel section and the second outer top panel section can be folded outwardly to extend upwardly from the first side panel and the second side panel, respectively, thereby forming an open top of the carton, with the handle extending across the open top.

According to an embodiment, a carton can comprise a first side panel, a second side panel opposite the first side panel, a bottom panel, a top panel, a first end panel, and a second end panel opposite the first end panel. The first end panel can include a first upper end closure flap overlapping a first lower end closure flap. The second end panel can include a second upper end closure flap overlapping a second lower end closure flap. A handle can extend in the top panel and can include first and second end portions in the first and second upper end closure flaps, respectively. The handle can be detachable from the top panel, and the first and second end portions of the handle can be at least partially detachable from the first and second upper end closure flaps, respectively.

A blank for forming a carton is also disclosed.

Other features, aspects, and embodiments will be apparent from the following description and accompanying figures.

BRIEF DESCRIPTION OF THE DRAWING FIGURES

DETAILED DESCRIPTION

The disclosure generally relates to cartons suitable for storing and dispensing articles such as, for example, beverage containers, and methods of erecting such cartons from a carton blank. Articles that can be contained by such cartons include, but are not limited to, petaloid bottle containers, beverage cans, glass or plastic bottles, or other containers such as those used in the packaging of juices and other foodstuffs. For purposes of illustration and not limitation, the detailed description below describes one embodiment of the invention within the context of a carton for beverage cans. However, any other appropriate containers or articles might be substituted for the beverage cans within the scope of the invention. Further, references herein to "end," "side," "bottom," and "top" refer to orientations or positions of elements when the carton is erected and disposed in an upright orientation. The terms "upper," "lower," "vertical," "horizontal," "lateral," and "oblique," and any variations thereof, generally refer to the location and/or orientation of an element or line with respect to a drawing figure in which it appears.

Figure 1:
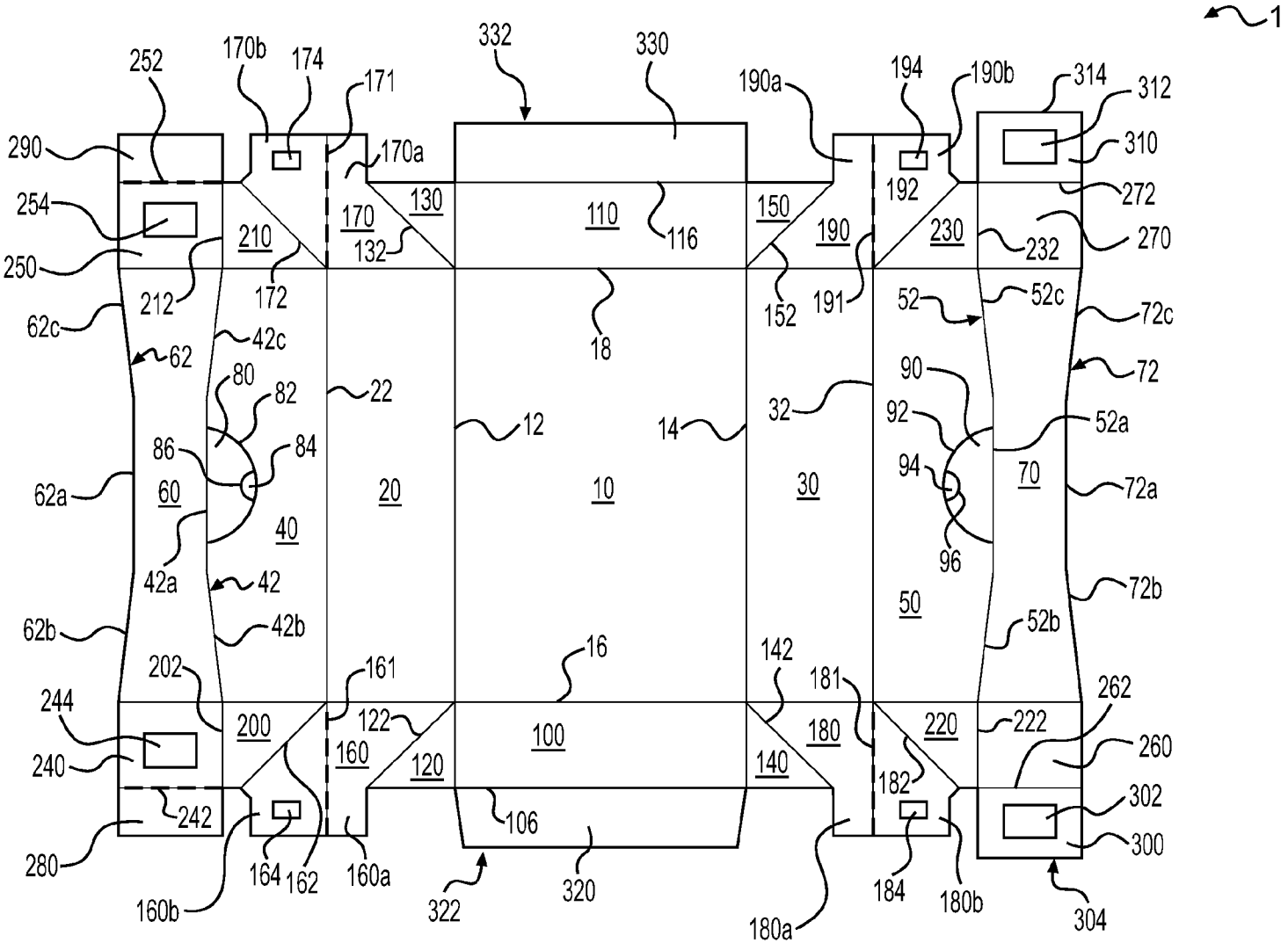
FIG. 1 is a plan view of a carton blank according to an embodiment of this disclosure, with an outer or print side of the blank facing upwardly.
Figure 2:
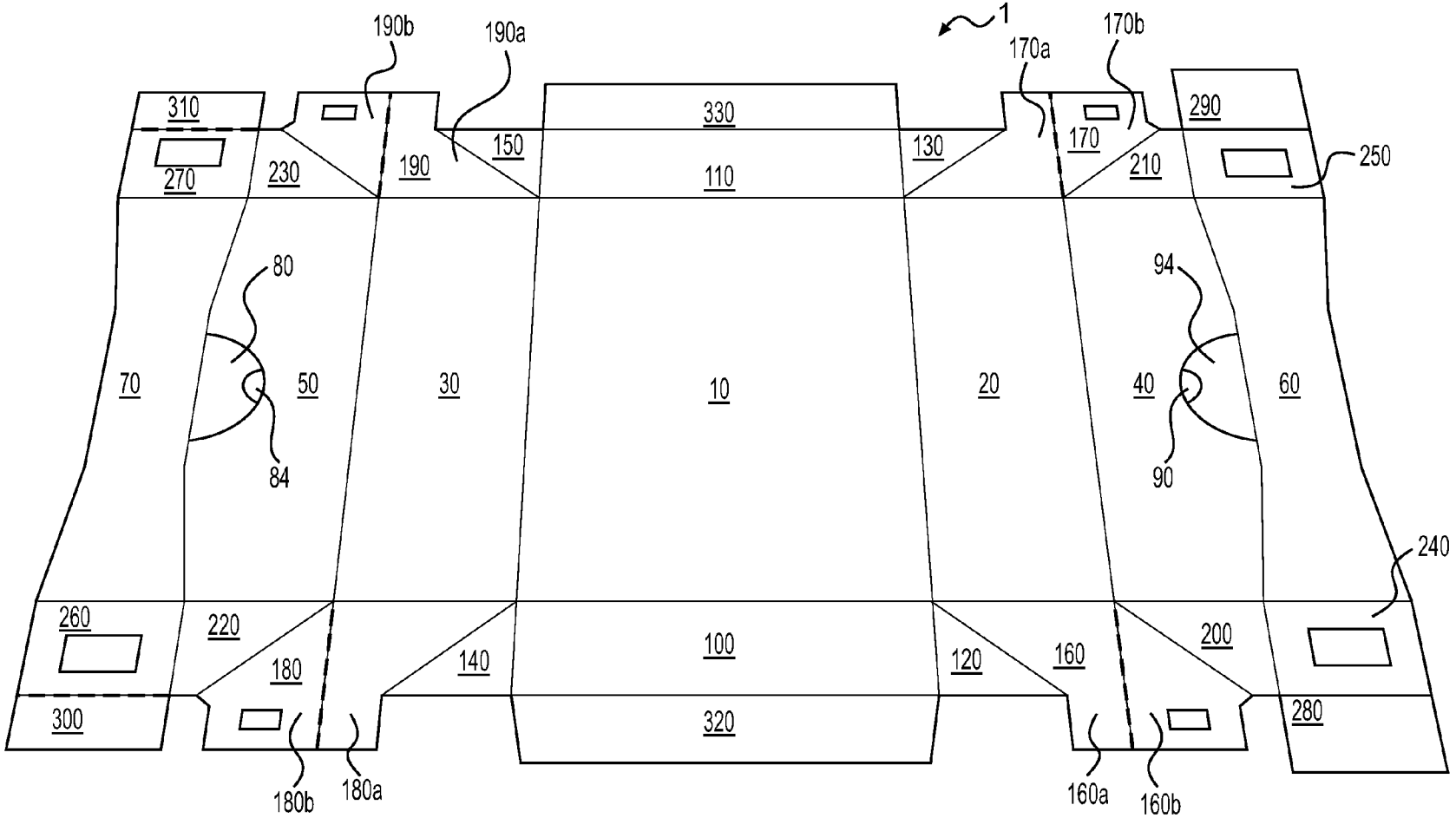
FIG. 2 shows the carton blank of FIG. 1 with its inner side facing upwardly (outer or print side facing downwardly).

Referring now in more detail to the drawing figures, wherein like reference numerals indicate like parts throughout the several views, FIGS. 1 and 2 illustrate a carton blank 1 from which a carton 400 (FIGS. 15 and 16) can be erected. The blank 1 is shown with its outside or print side up in FIG. 1, and with its inner side facing up in FIG. 2. The blank 1 includes a bottom panel 10, a first side panel 20, a second side panel 30, a first outer top panel section 40, a second outer top panel section 50, a first central top panel section, or handle panel section 60, and a second central top panel section 70. Horizontal fold lines 16, 18 form front and rear edges, respectively, of the panels 10, 20, 30 and the panel sections 40, 50, 60 and 70. The first and second side panels 20, 30 are foldably connected to opposite sides of the bottom panel 10 along vertical fold lines 12, 14, respectively. The first and second outer top panel sections 40, 50 are connected to the first and second side panels 20, 30, respectively, by vertical fold lines 22, 32. The first and second outer top panel sections 40, 50 include respective handle access panels 80, 90 defined by arcuate tear lines 82, 92. The handle access panels 80, 90 include respective finger tabs 84, 94 defined by arcuate tear lines 86, 96 which have endpoints intersecting the arcuate tear lines 82, 92, respectively. The first and second central top panels 60, 70 are connected to the first and second outer top panel sections 40, 50, respectively by tear lines 42, 52, which extend transversely to the fold lines 16, 18.

The panels 10, 20, 30 and the panel sections 40, 50, 60, 70 are substantially rectangular in shape. However, the first and second outer top panels 40, 50 and the first and second central top panel sections 60, 70 are not perfectly rectangular, due to the pattern of the tear lines 42, 52 and exterior side edges 62, 72 of the first and second central top panel sections 60, 70. Specifically, the tear lines 42, 52 include vertically extending central segments 42*a*, 52*a*, obliquely extending first end segments 42*b*, 52*b* and obliquely extending second end segments 42*c*, 52*c*. Similarly, the edges 62, 72 include vertically extending central segments 62*a*, 72*a*, obliquely extending first end segments 62*b*, 72*b* and obliquely extending second end segments 62*c*, 72*c*. The tear line 42 and the outer edge 62 are spaced apart in the first central top panel section 60, with the first end segments 42*b*, 62*b* diverging from each other and the second end segments 42*c*, 62*c* diverging from each other. Similarly, the tear line 52 and the outer edge 72 are spaced apart in the second central top panel 70, with the first end segments 52*b*, 72*b* diverging from each other and the second end segments 52*c*, 72*c* diverging from each other. Thus, the end portions of the central top panel sections 60, 70 are wider than the central portions of the central top panels 60, 70.

The blank 1 includes a first bottom end panel 100 foldably connected to a first end of the bottom panel 10 along the fold line 16 and a second bottom end panel 110 foldably connected to a second end of the bottom panel 10 along the fold line 18. The first and second bottom end panels 100, 110 can be rectangular in shape. A first lower gusset 120 is foldably connected to a first side of the first bottom end panel 100 along the fold line 12, and a second lower gusset 140 is foldably connected to a second side of the first bottom end panel 100 along the fold line 14. A third lower gusset 130 is foldably connected to a first side of the second bottom end panel 110 along the fold line 12, and a fourth lower gusset 150 is foldably connected to a second side of the second bottom end panel 110 along the fold line 14. In the embodiment shown, the gussets 120, 130, 140, 150 are substantially triangular in shape.

A first bottom end flap 320 is foldably connected to the first bottom end panel 100 along a horizontal fold line 106. A second bottom end flap 330 is foldably connected to the second bottom end panel 110 along a horizontal fold line 116. As shown in FIG. 1, the first and second bottom end flaps 320, 330 can be rectangular in shape.

The blank 1 further includes a first side end flap 160, a second side end flap 180, a third side end flap 170, and a fourth side end flap 190. The first and third side end flaps 160, 170 are foldably connected to opposite ends of the first side panel 20 along the fold lines 16, 18, respectively. The second and fourth side end flaps 180, 190 are foldably connected to opposite ends of the second side panel 30 along the fold lines 16, 18, respectively.

The first side end flap 160 includes two flap sections 160*a*, 160*b* connected by a fold line 161 extending collinearly from the fold line 22. The second side end flap 180 includes two flap sections 180*a*, 180*b* connected by a fold line 181 extending collinearly from the fold line 32. The third side end flap 170 includes two flap sections 170*a*, 170*b* connected by a fold line 171 extending collinearly from the fold line 22. The fourth side end flap 190 includes two flap sections 190*a*, 190*b* connected by a fold line 191 extending collinearly from the fold line 32. The flap sections 160*a*, 170*a*, 180*a*, 190*a* are foldably connected to respective lower gussets 120, 130, 140, 150 by oblique fold lines 122, 132, 142, 152.

The blank 1 includes a first upper gusset 200, a second upper gusset 220, a third upper gusset 210, and a fourth upper gusset 230. The first and third upper gussets 200, 210 are foldably connected to opposite ends of the first outer top panel 40 along the fold lines 16, 18, and are foldably connected to respective flap sections 160*b*, 170*b* of the first and third side end flaps 160, 170 along oblique fold lines 162, 172. The second and fourth upper gussets 220, 230 are foldably connected to opposite ends of the second outer top panel 50 along the fold lines 16, 18, and are foldably connected to respective panel sections 180*b*, 190*b* of the second and fourth side end flaps 180, 190 along oblique fold lines 182, 192.

First and second top attachment panels 240, 260 are foldably connected to first ends of the first and second central top panel sections 60, 70, respectively, along the fold line 16. The first and second top attachment panels 240, 260 are foldably connected to the first and second upper gussets 200, 220 along respective fold-and-tear lines 202, 222, which extend collinearly from the tear lines 42, 52, respectively. First and second top attachment flaps 280, 300 are foldably connected to the first and second top attachment panels 240, 260, respectively, along horizontal fold lines 242, 262. The first top attachment panel 240 and the second top attachment flap 300 can include respective adhesive regions 244, 302 on the outer surface of the blank 1.

Third and fourth top attachment panels 250, 270 are foldably connected to second ends of first and second central top panel sections 60, 70 along the fold line 18, and are foldably connected to the third and fourth upper gussets 210, 230 along fold-and-tear lines 212, 232, which extend collinearly from the tear lines 42, 52, respectively. Third and fourth top attachment flaps 290, 310 are foldably connected to the third and fourth top attachment panel 250, 270, respectively, along horizontal fold lines 252, 272. The third top attachment panel 250 and the fourth top attachment flap 310 can include adhesive regions 254, 312 on the outer surface of the blank 1.

Figure 3:
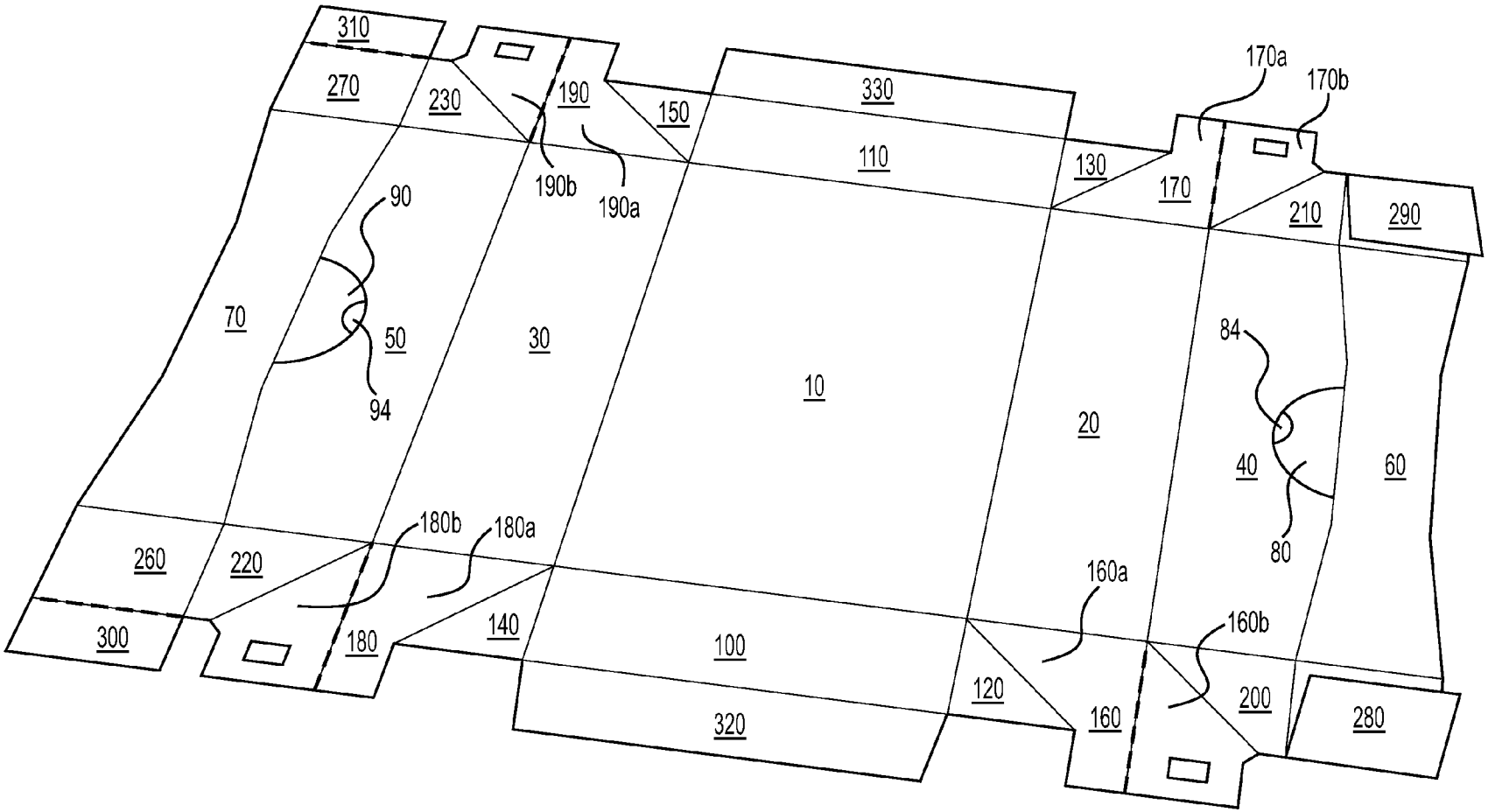
FIGS. 3-15 illustrate, in one form, a series of steps carried out in erecting a carton from the blank of FIGS. 1 and 2.
Figure 4:
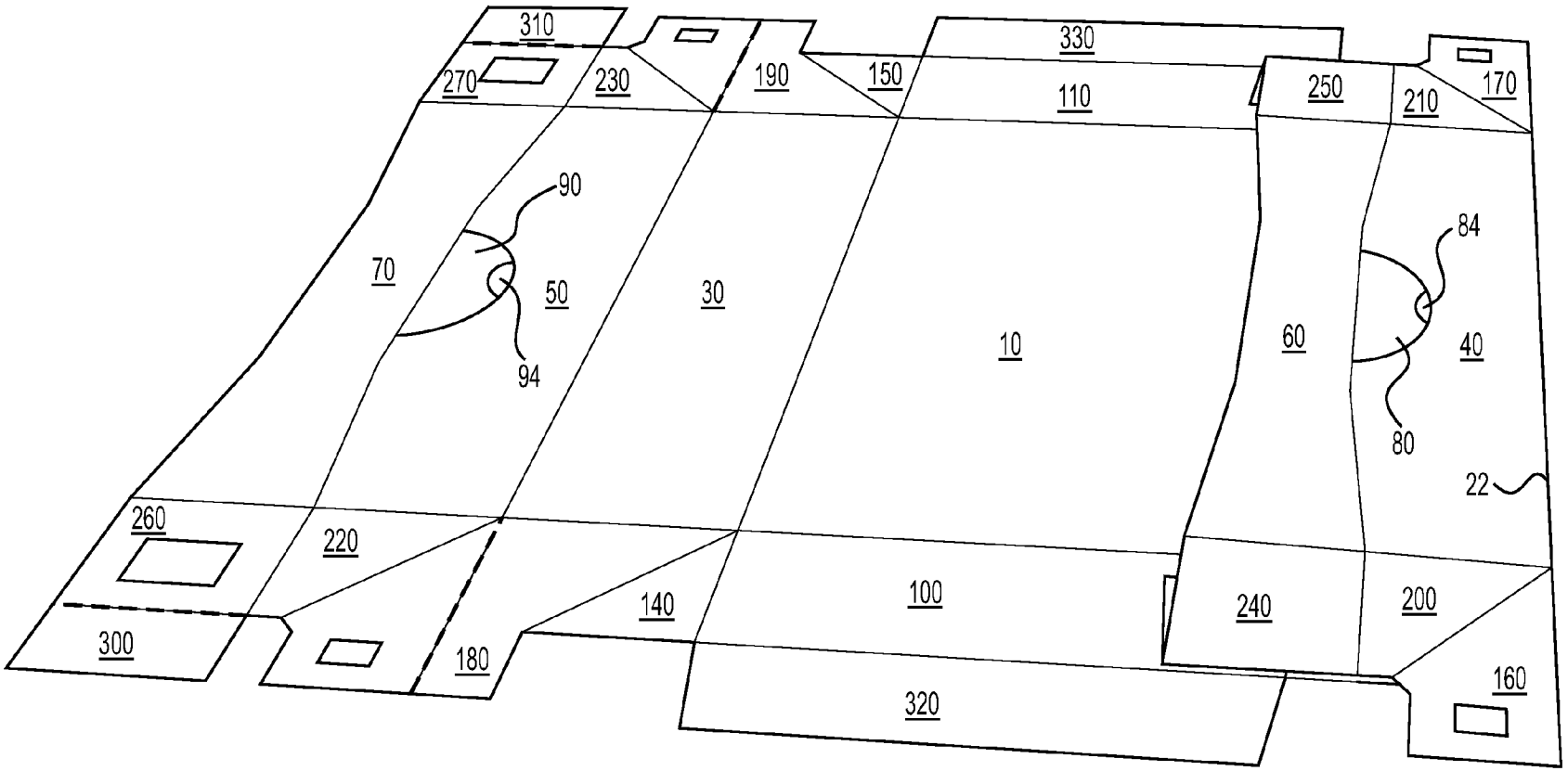
Figure 14:
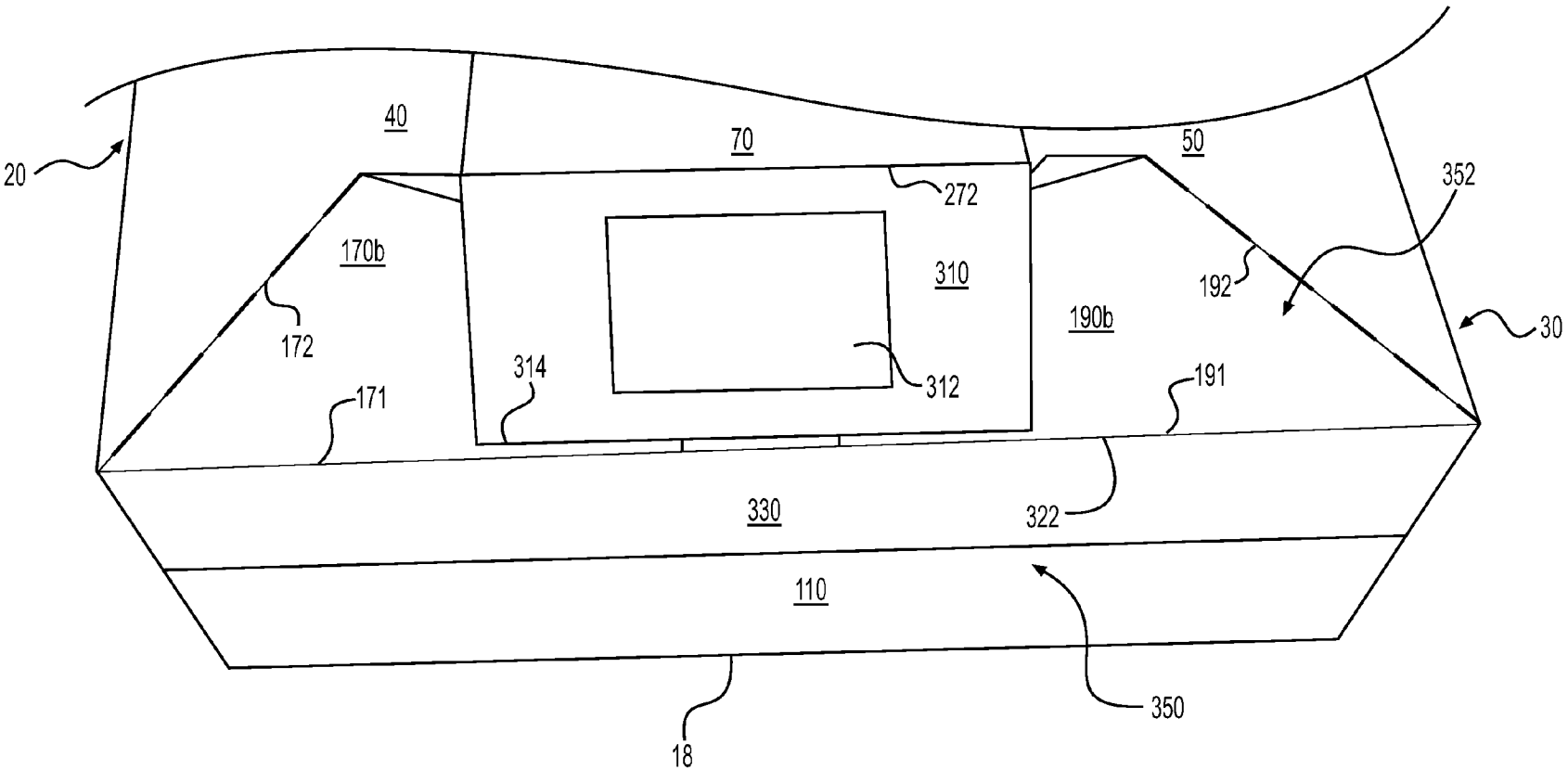
Figure 15:
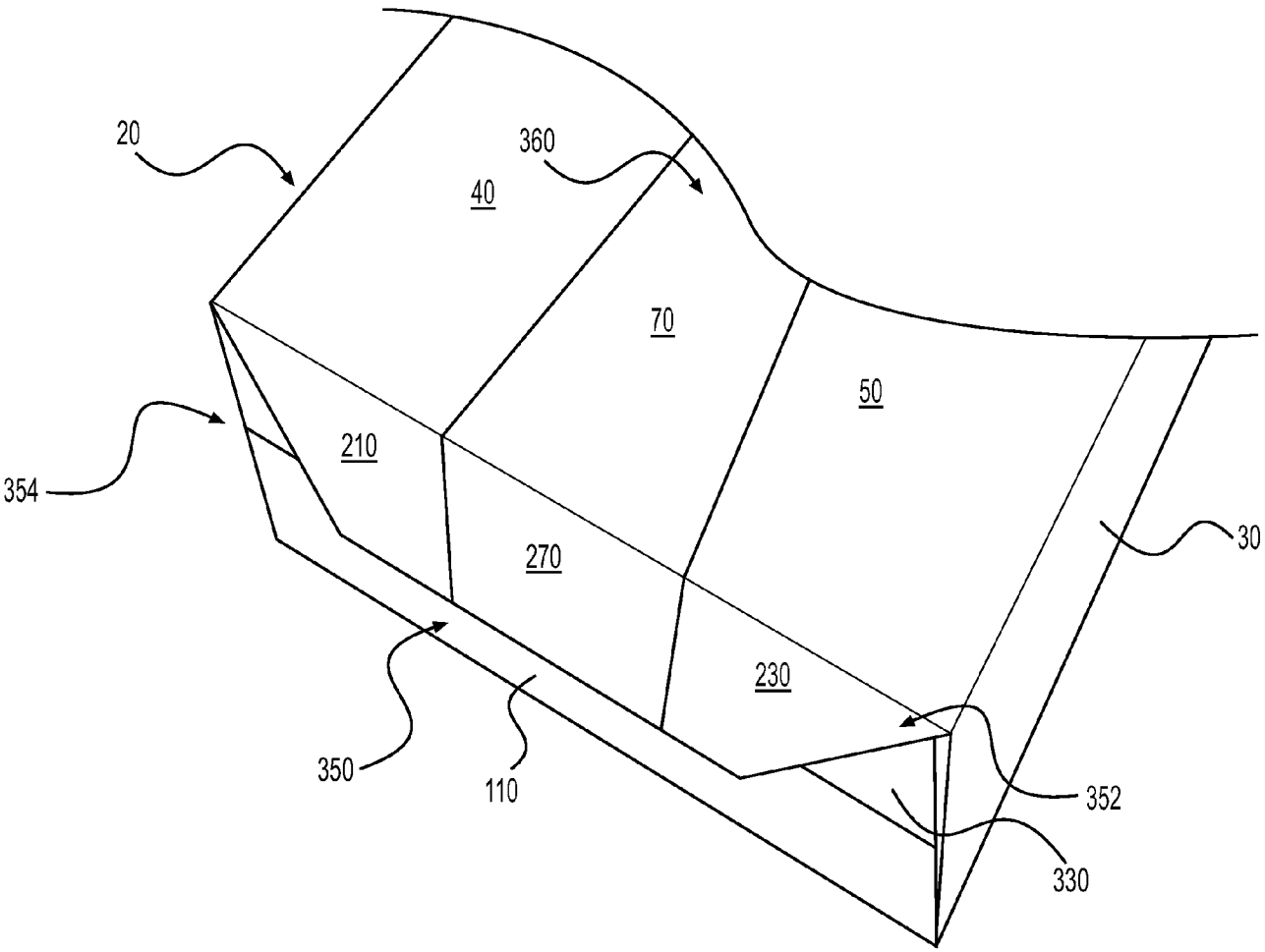
Figure 16:
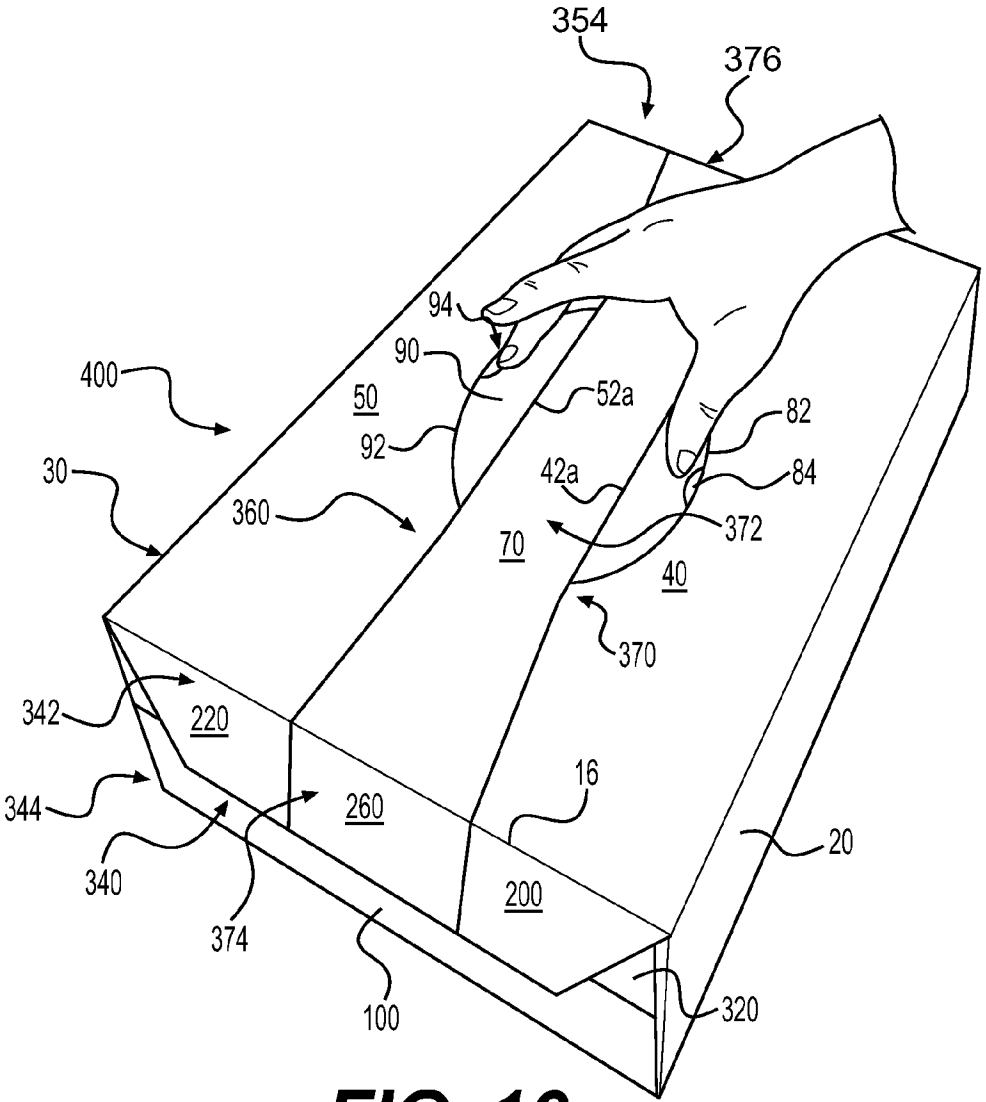
FIG. 16 shows the carton fully erected in a first configuration.

FIGS. 3-16 illustrate an example of a suitable method of erecting a carton 400 (FIGS. 15 and 16). Referring to FIG. 3, the first and third top attachment flaps 280, 290 are folded inwardly along respective fold lines 242, 252 into a substantially flat orientation against the first and third top attachment panels 240, 250, respectively, such that the inner surfaces of the first and third top attachment flaps 280, 290 face the inner surfaces of the first and third top attachment panels 240, 250. As shown in FIG. 4, the blank 1 is then folded along the fold line 22 such that the first outer top panel section 40 and the first central top panel section 60 lie substantially flat against a remainder of the blank 1, and the outer surfaces of the first outer top panel section 40 and the first central top panel section 60 face outwardly and the inner surfaces of the first outer top panel section 40 and the first central top panel section 60 face the inner surface of the remainder of the blank 1.

Figure 5:
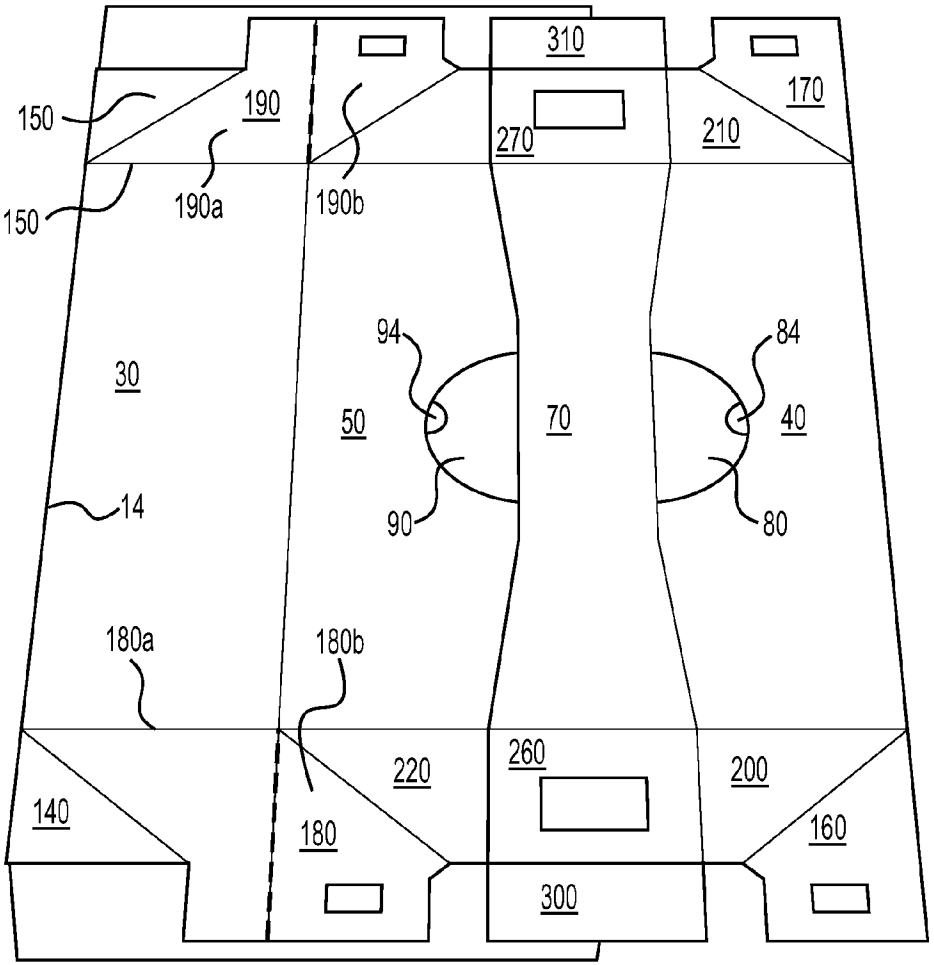

Thereafter, as shown in FIG. 5, the second central top panel section 70, the second outer top panel section 50 and the second side panel 30 are folded inwardly along the fold line 14 into a substantially flat orientation such that the second central top panel section 70 is aligned with the first central top panel section 60, and the inner surface of the second central top panel section 70 faces the outer surface of the first central top panel section 60. In this configuration, the second and fourth top attachment panels 260, 270 are aligned with the first and third top attachment panels 240, 250, respectively. The inner surface of the second top attachment panel 260 is adhesively attached to the outer surface of the first top attachment panel 240 via the adhesive region 244, and the inner surface of the fourth top attachment panel 270 is adhesively attached to the outer surface of the third top attachment panel 250 via the adhesive region 254.

Figure 6:
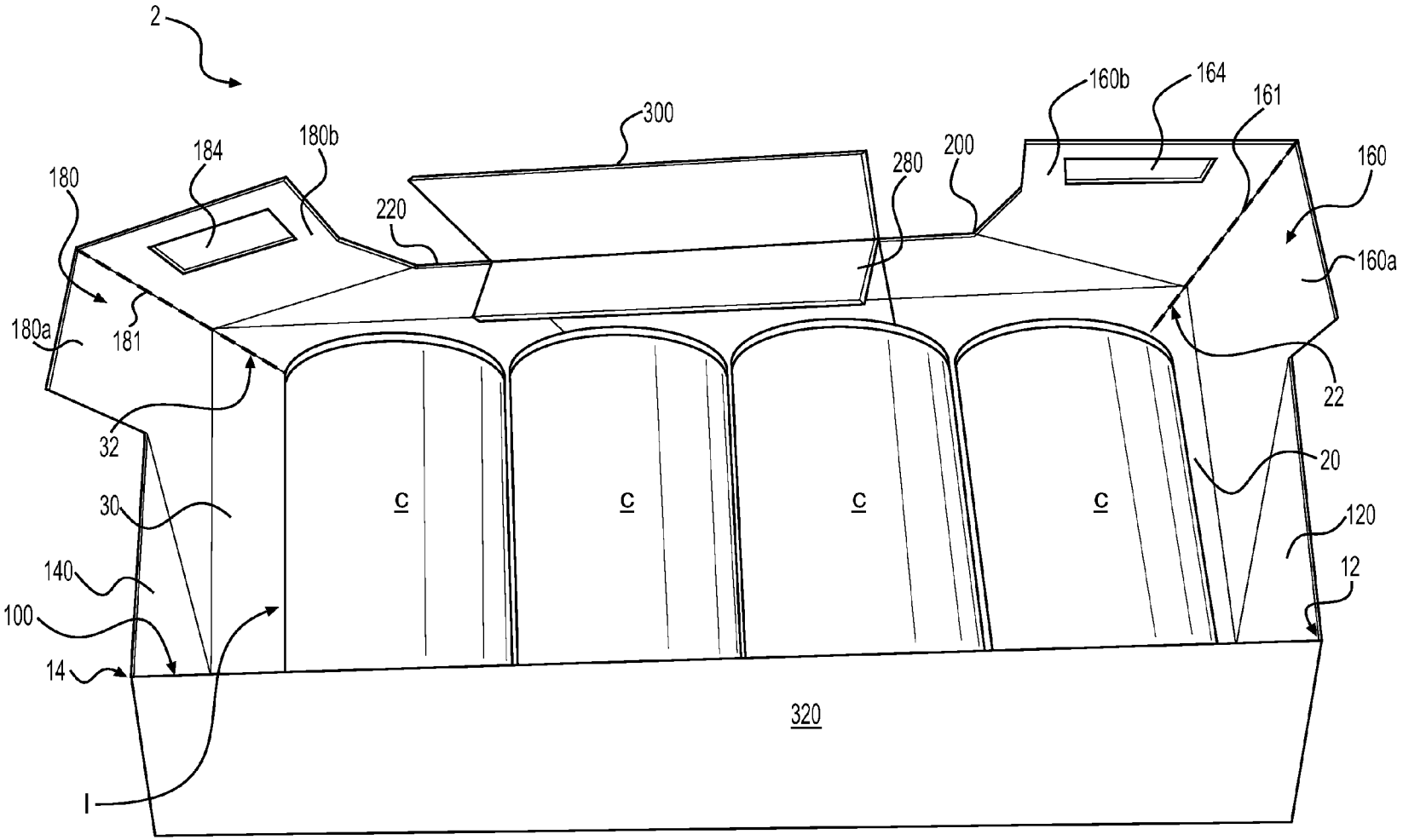
Figure 11:
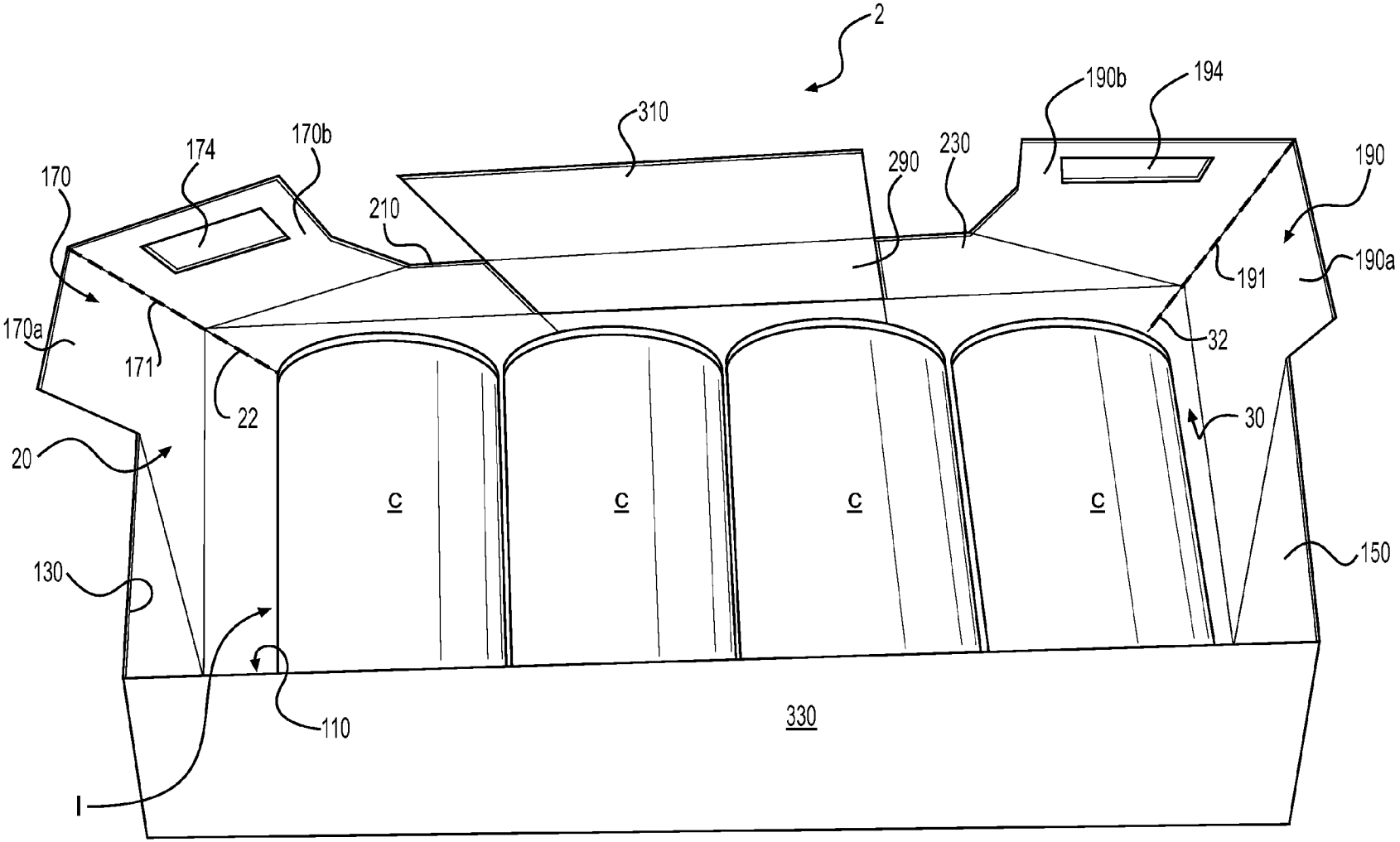

Next, as show in FIGS. 6 and 11, the blank is "opened" into a substantially rectangular tube 2. The tube 2 is formed by folding the blank along the fold lines 12, 14, 22, 32 such that the first and second side panels 20, 30 extend substantially parallel to each other and the top panel sections 40, 50, 60, 70 form a top panel 360 extending substantially parallel to the bottom panel 10, with the top panel 360 and the bottom panel 10 extending substantially perpendicularly to the first and second side panels 20, 30. A plurality of containers C can be loaded into the interior I of the tube 2. The containers C can be cylindrical cans, bottles or other types of containers.

Figure 7:
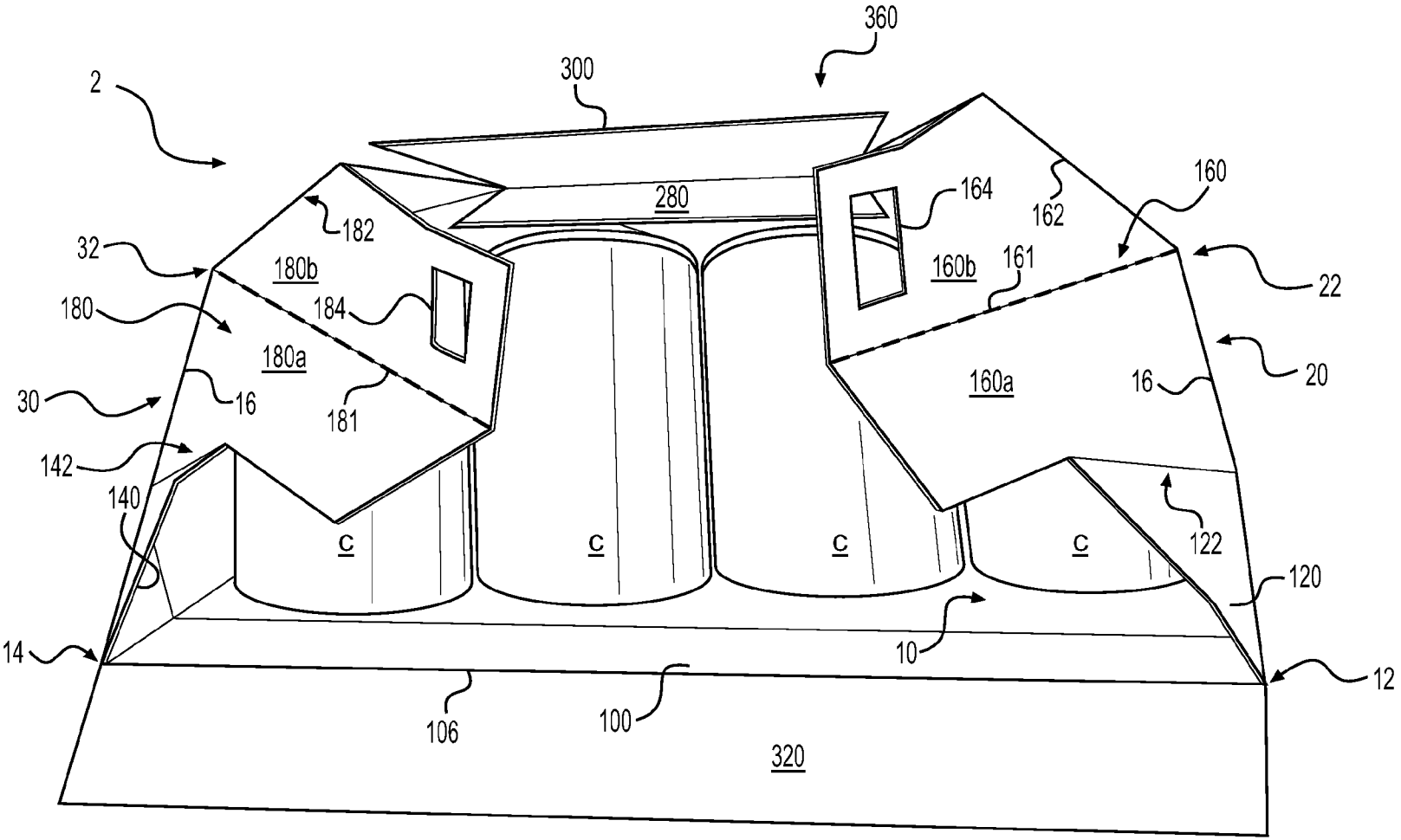
Figure 8:
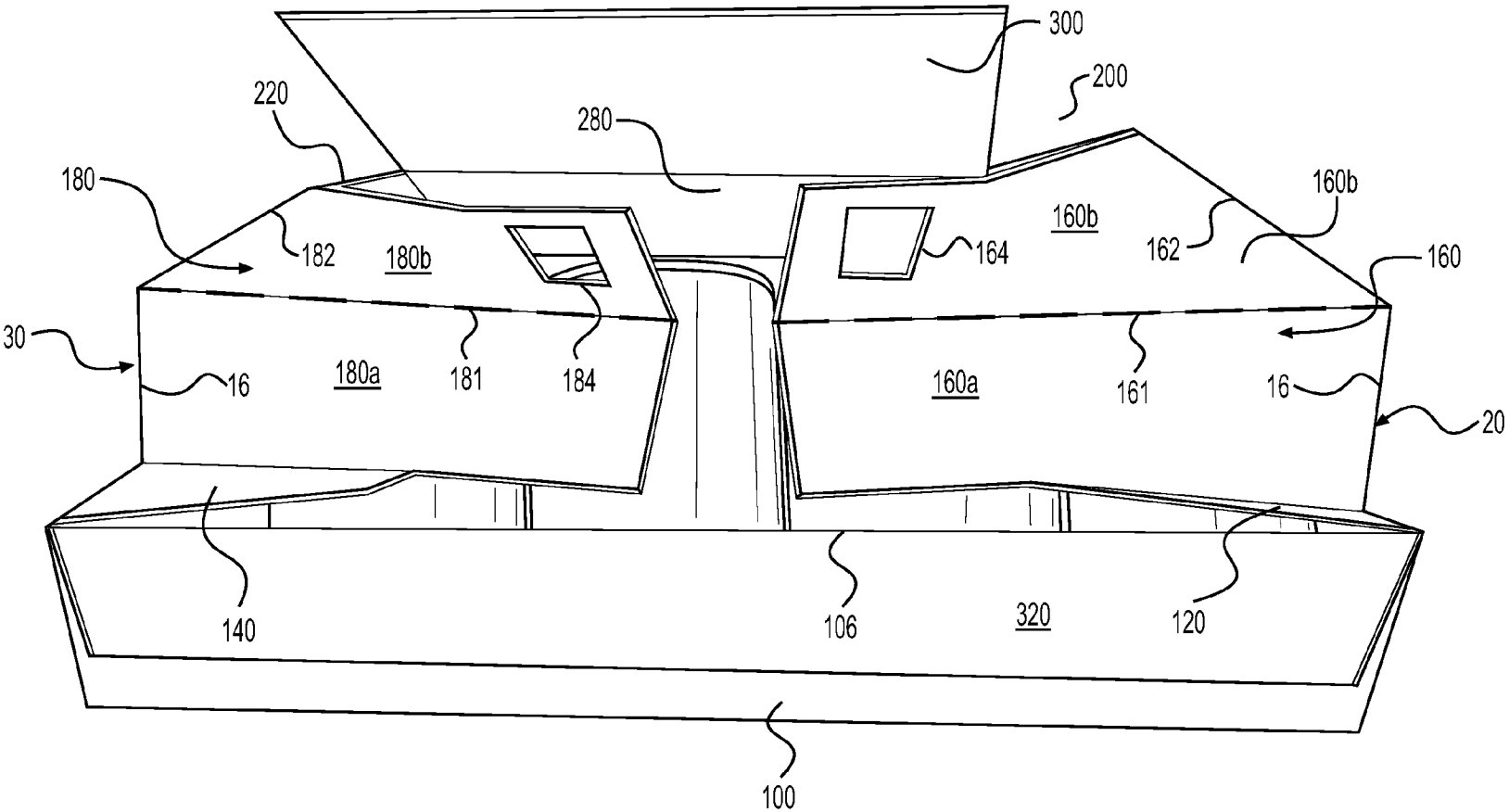

As shown in FIG. 7, the first side end flap 160 is folded inwardly towards the interior I of the tube 2 along the fold lines 16, 122, 162 so as to extend transversely with respect to the first and second side panels 20, 30. The second side end flap 180 is folded inwardly towards the interior I of the tube 2 along the fold lines 16, 142, 182 so as to extend transversely with respect to the first and second side panels 20, 30. The first and second side end flaps 160, 180 also fold slightly along their respective fold lines 161 and 181 during this step. As illustrated in FIG. 8, the first and second lower gussets 120, 140 are folded inwardly and downwardly about the fold lines 12, 122 and the fold lines 14, 142, respectively, such that the inner surfaces of the first and second lower gussets 120, 140 lie substantially flat, facing the inner surface of the first bottom end panel 100.

Figure 9:
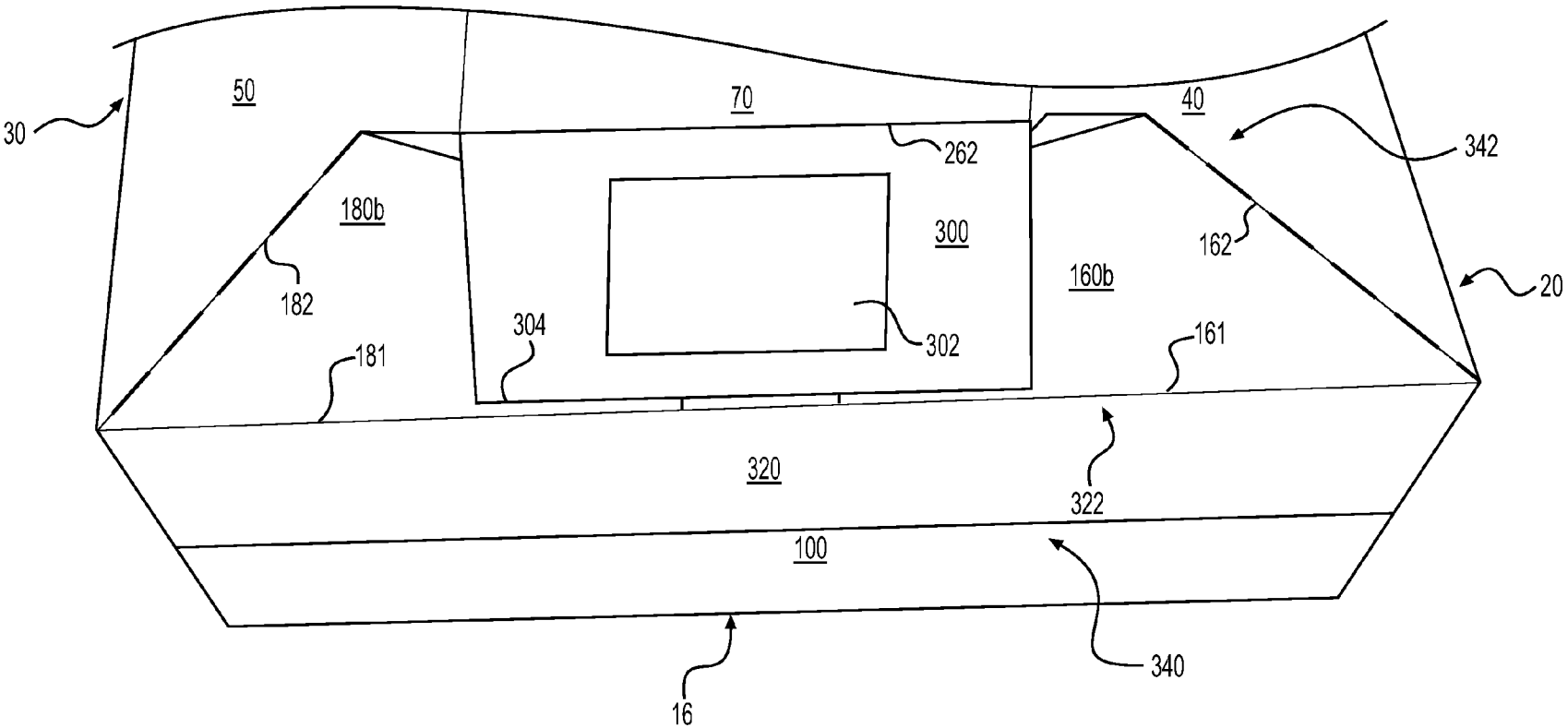

Next, as shown in FIG. 9, the first bottom end panel 100 and the first bottom end flap 320 are folded inwardly and upwardly about the fold line 16 with respect to the bottom panel 10 such that the first bottom end panel 100 and the first bottom end flap 320 extend transversely between the first and second side panels 20, 30 and the top and bottom panels 10, 360. The first and second lower gussets 120, 140 are simultaneously folded upwardly about respective fold lines 122, 142 and are thereby respectively tucked between the flap section 160*a* and the first bottom end panel 100, and the flap section 180*a* and the first bottom end panel 100. The first bottom end flap 320 can then be adhesively attached to the flap sections 160*a*, 180*a* such that the first bottom end flap 320 overlies the flap sections 160*a*, 180*a* of the first and second side end flaps 160, 180, respectively, and a laterally extending free edge 322 of the first bottom end flap 320 is aligned with the fold lines 161, 181 in the first and second side end flaps, 160, 180. The first bottom end panel 100, the first bottom end flap 320, and the first and second lower gussets 120, 140 thereby form a first lower end closure flap 340.

Still referring to FIG. 9, the flap sections 160*b*, 190*b* are folded upwardly along the fold lines 161, 181, respectively, as the first and second upper gussets 200, 220 and the second top attachment panel 240 are folded upwardly about the fold line 16. The second top attachment flap 300 is then folded over the flap sections 160*b*, 180*b* along the fold line 262 such that the inner surface of the second top attachment flap 300 contacts the outer surfaces of the flap sections 160*b*, 190*b*, and a free lateral edge 304 of the second top attachment flap 300 is aligned with the fold lines 161, 181. The flap sections 160*b*, 180*b* are thereby engaged between the second top attachment flap 300 and the first top attachment flap 280 (FIG. 8). The flap sections 160*b*, 180*b* can be adhesively attached to the first and second top attachment flaps 280, 300. Thus, the flap sections 160*b*, 180*b*, the first and second top attachment panels 240, 260, the first and second top attachment flaps 280, 300 and the first and second upper gussets 200, 220 form a first upper end closure flap 342.

Figure 10:
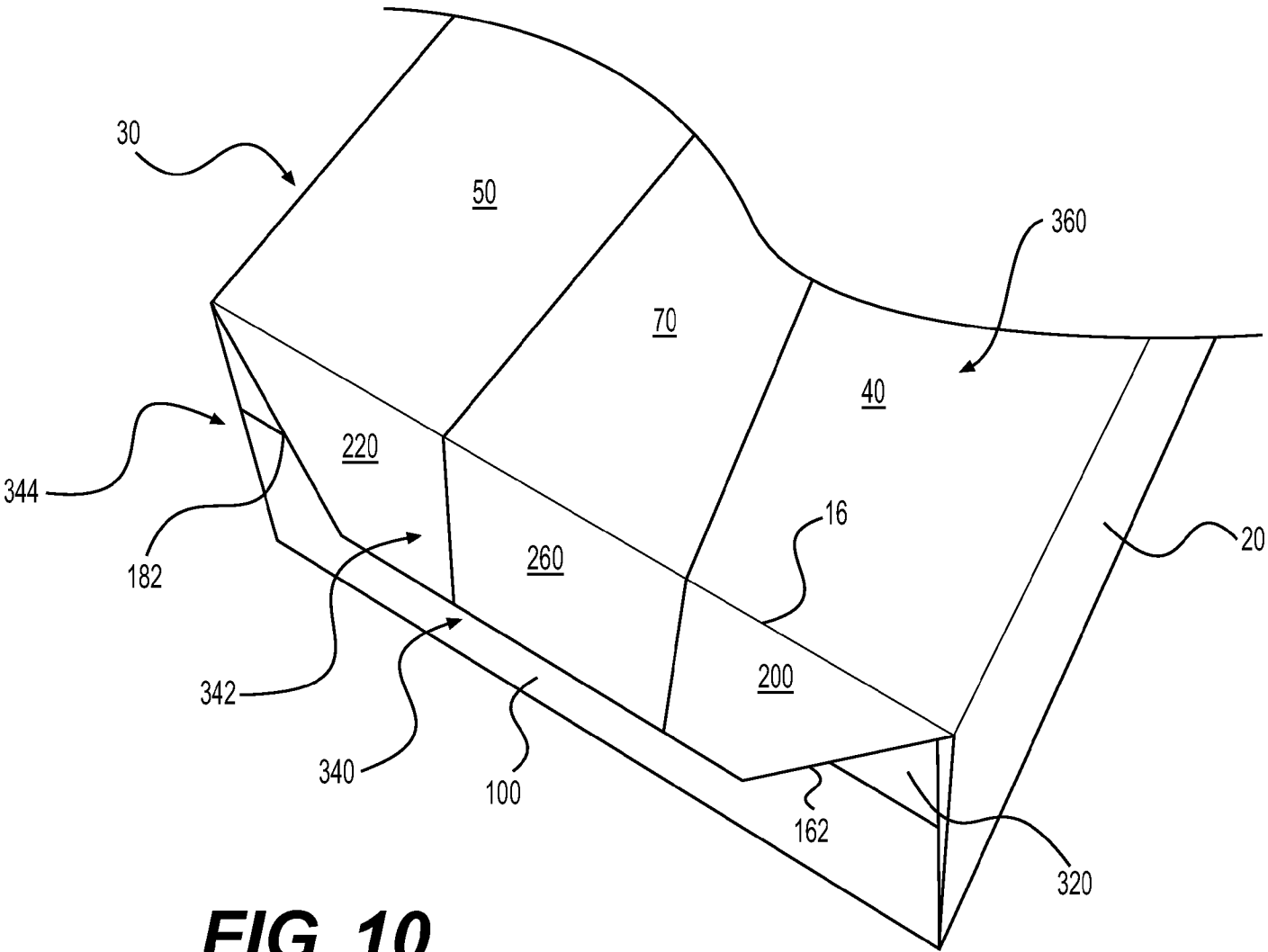

Referring now to FIG. 10, after completing the steps illustrate in FIG. 9, the first upper end closure flap 342 is folded inwardly and downwardly about the fold line 16 so as to extend transversely between the first and second side panels 20, 30 and the top and bottom panels 10, 360. During this folding step, the respective flap sections 160*b*, 180*b* of the first and second side end flaps 160, 180 are folded inwardly and downwardly about their respective fold lines 161, 181, and the outer surface of the second top attachment flap 300 is placed against the outer surface of the first lower end closure flap 340. The first upper end closure flap 342 is secured to the first lower end closure flap 340 by adhesive attachment of the second top attachment flap 300 to the first lower end closure flap 340 at the adhesive region 302. Thus, the first upper end closure flap 342 overlaps the first lower end closure flap 340, and the first upper end closure flap 342 and the first lower end closure flap 340 combine to form a first end panel 344 extending transversely between the first and second side panels 20, 30, and the top and bottom panels 360, 10.

The steps illustrated in FIGS. 7-10 are repeated for the opposite end of the tube 2, as will now be described in detail with respect to FIGS. 12-15.

Figure 12:
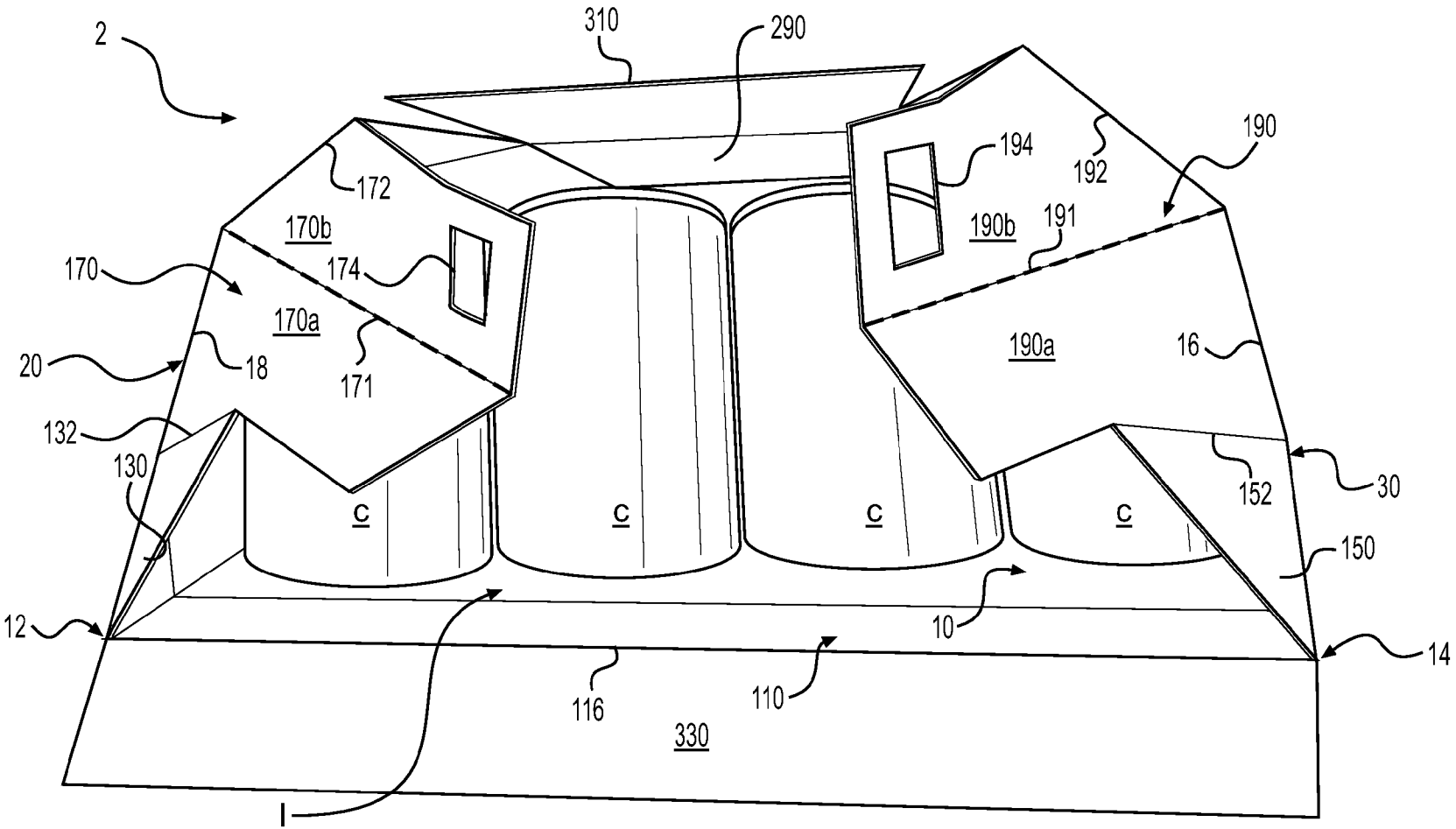
Figure 13:
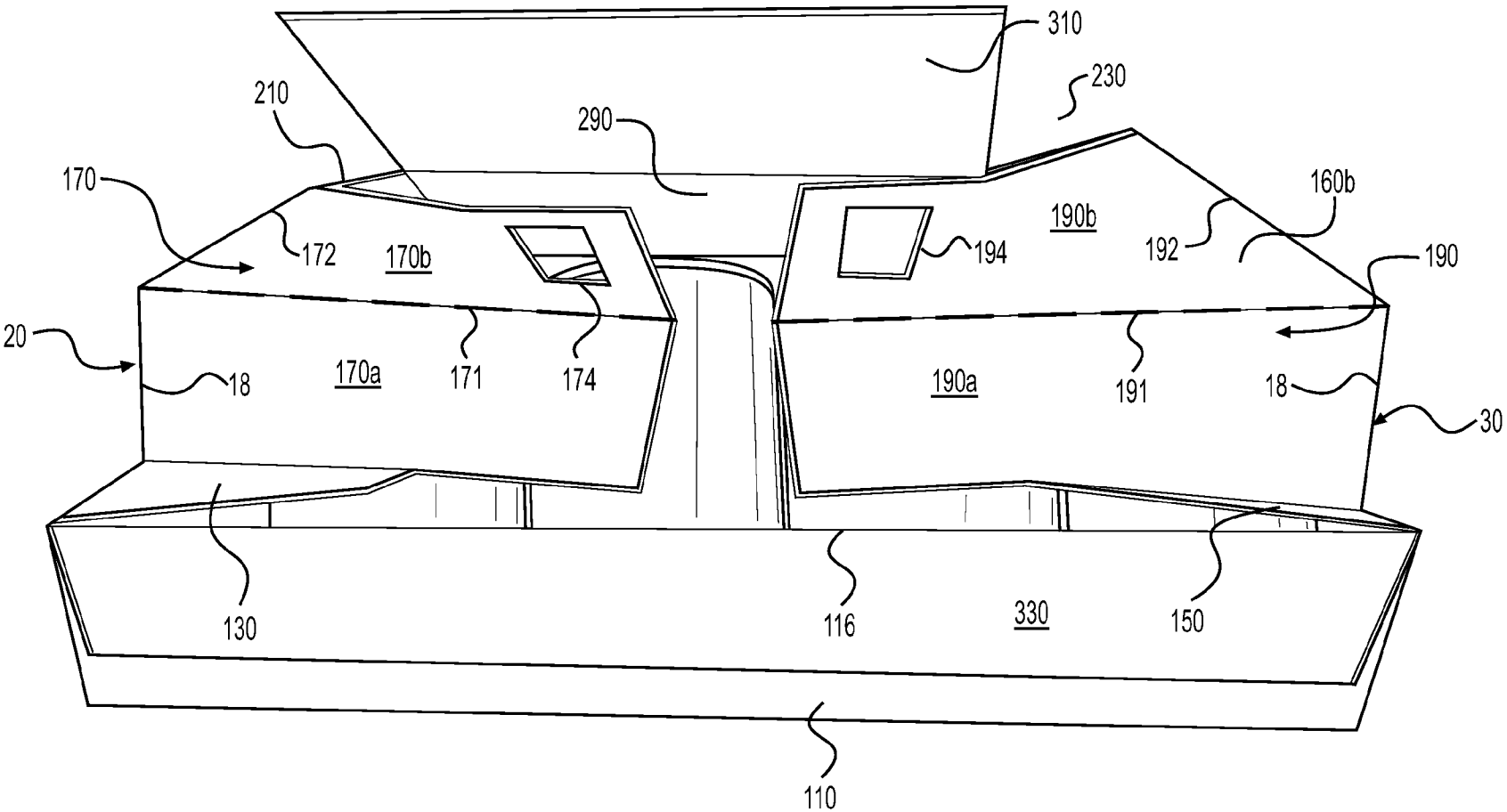

As shown in FIG. 12, the third side end flap 170 is folded inwardly towards the interior I of the tube 2 along the fold lines 18, 132, 172 so as to extend transversely with respect to the first and second side panels 20, 30. The fourth side end flap 190 is folded inwardly towards the interior I of the tube 2 along the fold lines 18, 152, 192 so as to extend transversely with respect to the first and second side panels 20, 30. The third and fourth side end flaps 170, 190 also fold slightly along their respective fold lines 171 and 191 during this step. As illustrated in FIG. 13, the third and fourth lower gussets 130, 150 are folded inwardly and downwardly about the fold lines 12, 132 and the fold lines 12, 152, respectively, such that the inner surfaces of the third and fourth lower gussets 130, 150 lie substantially flat, facing the inner surface of the second bottom end panel 110.

Thereafter, as illustrated in FIG. 14, the second bottom end panel 110 and the second bottom end flap 330 are folded inwardly and upwardly about the fold line 18 with respect to the bottom panel 10 such that the second bottom end panel 110 and the second bottom end flap 330 extend transversely between the first and second side panels 20, 30 and the top and bottom panels 10, 360. The third and fourth lower gussets 130, 150 are simultaneously folded upwardly about respective fold lines 132, 152 and are thereby respectively tucked between the third side end flap 170 and the second bottom end panel 110, and the fourth side end flap 190 and the second bottom end panel 110. The second bottom end flap 330 can then be adhesively attached to the flap sections 170*a*, 190*a* such that the second bottom end flap 330 overlies the flap sections 170*a*, 190*a* and a laterally extending free edge 332 of the second bottom end flap 330 is aligned with the fold lines 171, 191 in the third and fourth side end flaps, 170, 190. A second lower end closure flap 350 is thereby formed by the second bottom end panel 110, the second bottom end flap 330, and the second and fourth lower gussets 130, 150.

Referring again to FIG. 14, the flap sections 170*b*, 190*b* are folded upwardly along the fold lines 171, 191, respectively, as the third and fourth upper gussets 210, 230 and the fourth top attachment panel 270 are folded upwardly about the fold line 18. The fourth top attachment flap 310 is then folded over the flap sections 170*b*, 190*b* along the fold line 272 such that the inner surface of the fourth top attachment flap 310 contacts the outer surfaces of the flap sections 170*b*, 190*b*, and a free lateral edge 314 of the fourth top attachment flap 310 is aligned with the fold lines 171, 191. The flap sections 170*b*, 190*b* are thereby engaged between the fourth top attachment flap 310 and the third top attachment flap 290 (FIG. 13). The flap sections 170*b*, 190*b* can be adhesively attached to the third and fourth top attachment flaps 290, 310. Thus, a second upper end closure flap 352 is formed by the flap sections 170*b*, 190*b*, the third and fourth top attachment panels 250, 270, the third and fourth top attachment flaps 290, 310 and the third and fourth upper gussets 210, 230.

Turning to FIG. 15, the second upper end closure flap 352 is then folded inwardly and downwardly about the fold line 18 so as to extend transversely between the first and second side panels 20, 30 and the top and bottom panels 10, 360. During this folding step, the respective flap sections 170*b*, 190*b* of the third and fourth side end flaps 170, 190 are folded inwardly and downwardly about their respective fold lines 171, 191, and the outer surface of the fourth top attachment flap 310 is placed against the outer surface of the second lower end closure flap 350. The second upper end closure flap 352 is secured to the second lower end closure flap 350 by adhesive attachment of the fourth top attachment flap 310 to the second lower end closure flap 350 at the adhesive region 312. As a result, the second upper end closure flap 352 overlaps the second lower end closure flap 350, and the second upper end closure flap 352 and the second lower end closure flap 350 combine to form a second end panel 354 extending transversely between the first and second side panels 20, 30 and the top and bottom panels 360, 10.

FIG. 16 shows the fully erected carton 400. In this configuration, the carton 400 is generally suitable for storing and shipping the containers C. The carton 400 is parallelpipedal and includes the top panel 360, the bottom panel 10 (see FIGS. 7 and 12), the first and second side panels 20, 30 extending substantially perpendicularly to the top and bottom panels 360, 10, and the first and second end panels 344, 354 extending substantially perpendicularly to the first and second side panels 20, 30 and the top and bottom panels 360, 10. The carton 400 includes a central handle 370 having a central gripping portion 372 extending longitudinally across the top panel 360, a first end portion 374 in the first top end flap 342, and a second end portion 376 in the second top end flap 352 (see FIG. 15). The central gripping portion 372 of the handle 370 is formed by the second center top panel section 70 and the first center top panel section 60 underlying the second center top panel section 70. The first end portion 372 is formed by the second top attachment panel 260 and the first top attachment panel 240, which is positioned behind the second top attachment panel 260. The second end portion 374 is formed by the fourth top attachment panel 270 and the third top attachment panel 250, which is positioned behind the fourth top attachment panel 270. The first and second handle access panels 80, 90 are positioned on opposite lateral sides of the central gripping portion 372 of the handle 370.

Figure 17:
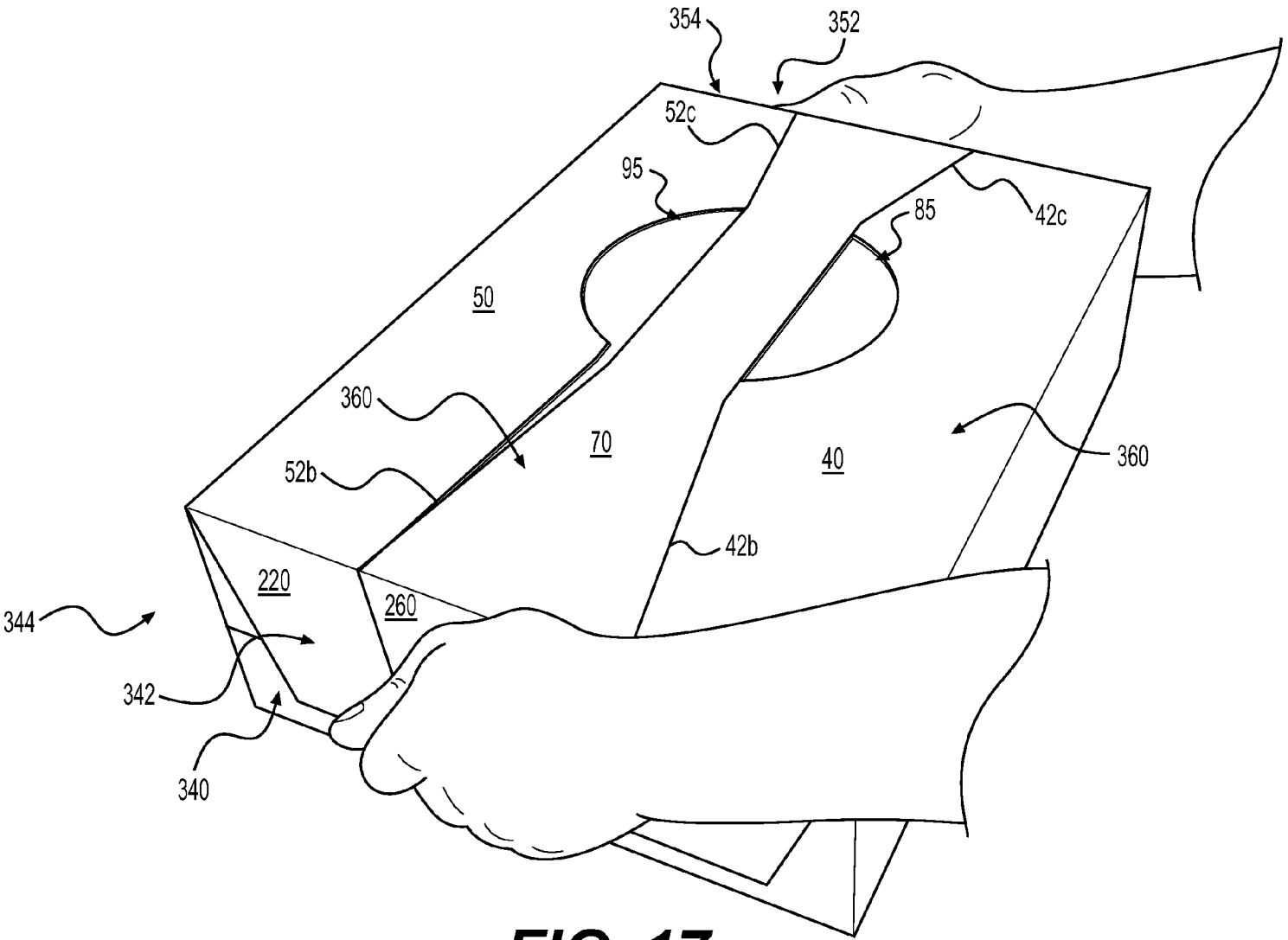
FIGS. 17-19 illustrate, in one form, a series of steps carried out in opening the erected carton and converting the carton to a second configuration forming a cooler for chilling and dispensing containers.
Figure 18:
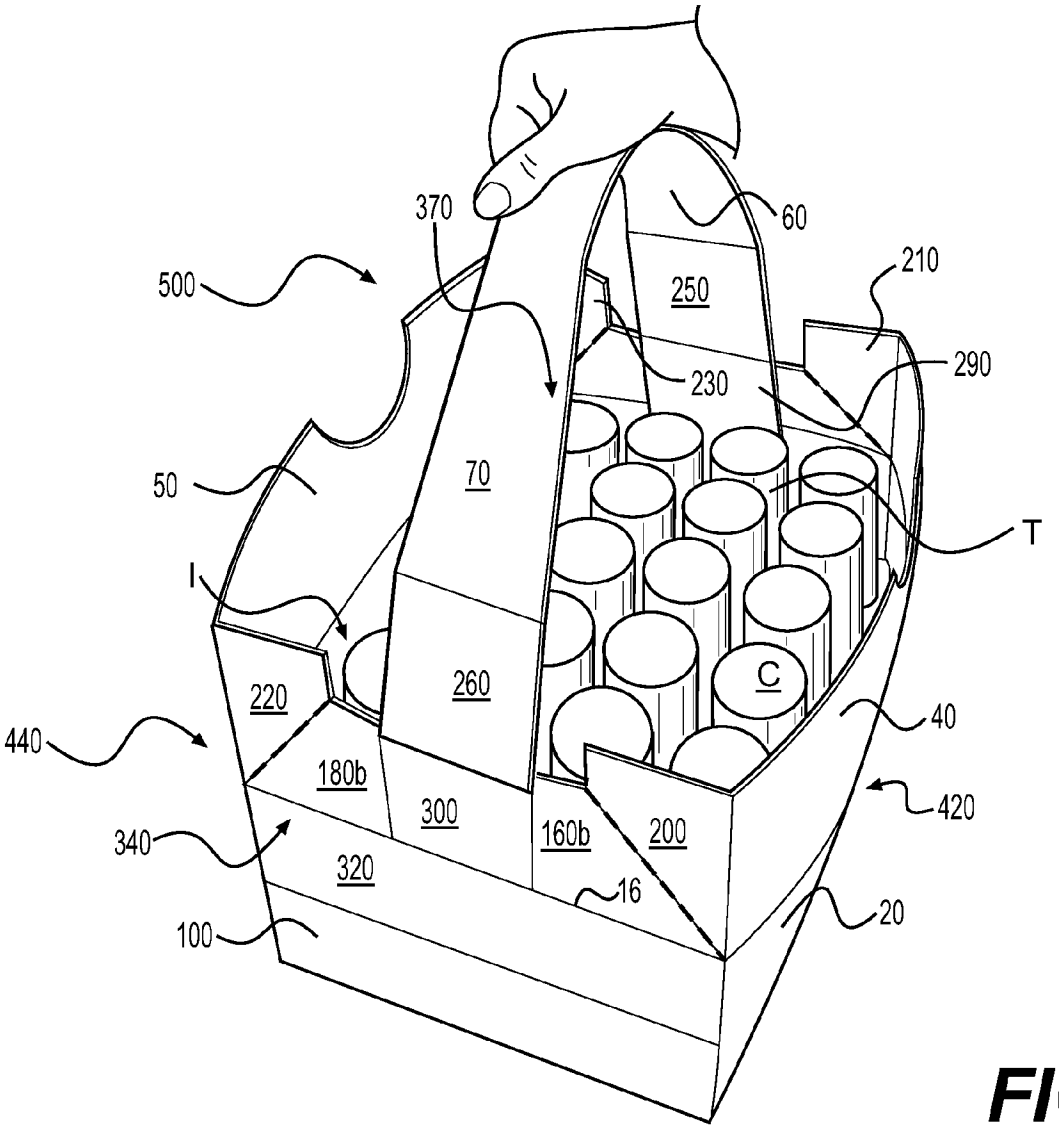
Figure 19:
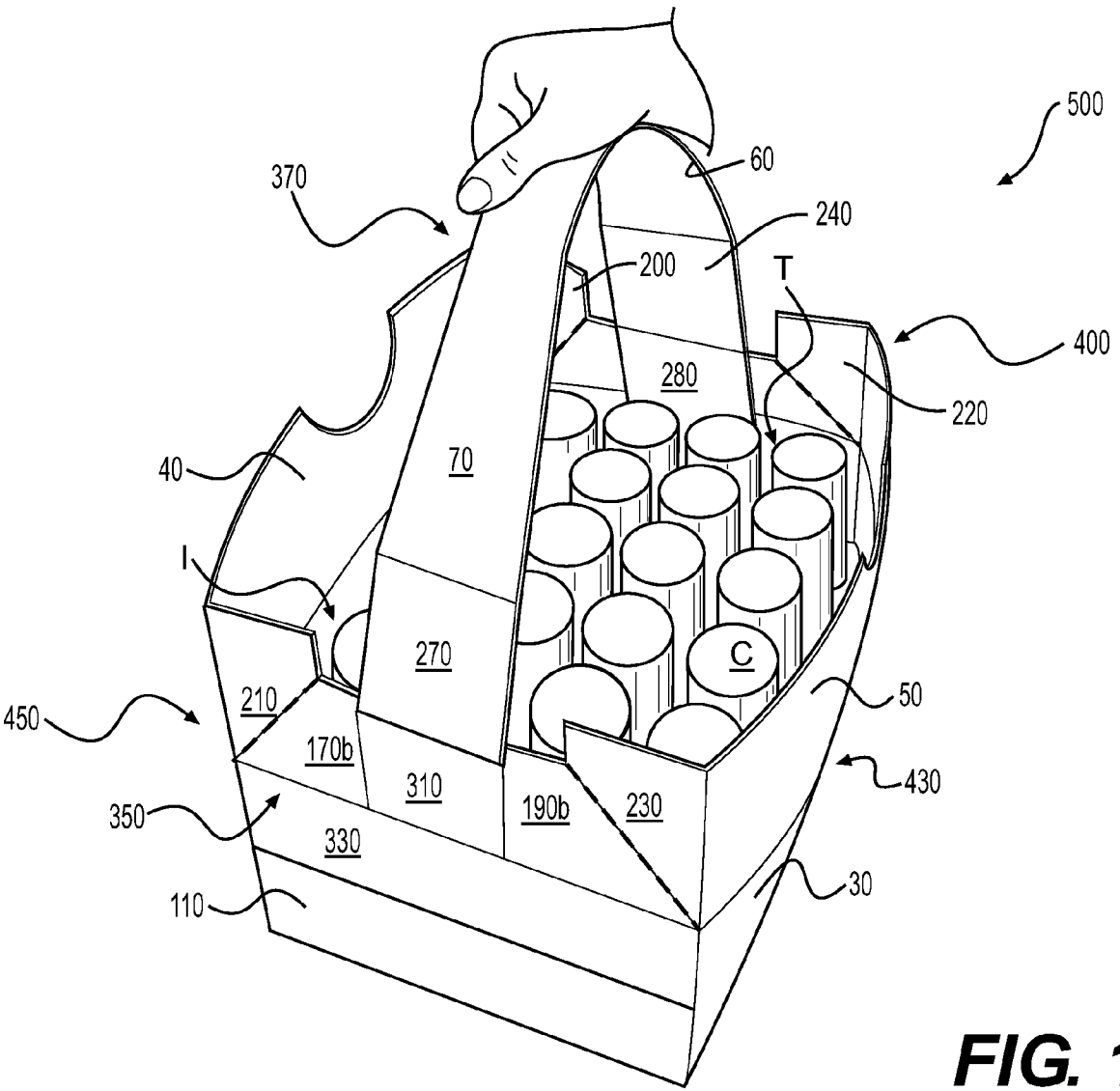

FIGS. 17-19 illustrate an example of a suitable procedure for converting the carton 400 to an open-top basket or cooler 500 that is fillable with ice for chilling the containers C therein. Referring to FIG. 17, a person can at least partially separate the finger tabs 84, 94 from the respective handle access panels 80, 90 along the tear lines 86, 96 and/or the tear line segments 42*a*, 52*a* of the tear lines 42, 52 using fingers or thumbs, and then grip the handle access panels 80, 90 and at least partially separate the handle access panels 80, 90 from the first and second outer top panel sections 40, 50, respectively, along the respective arcuate tear lines 82, 92 and/or tear line segments 42*a*, 52*a*. Separation of the handle access panels 80, 90 from the first and second outer top panel sections 40, 50 leaves respective openings 85, 95 in the first and second outer top panel sections 40, 50 providing access to the handle 370. The openings 85, 95 are illustrated as being substantially semi-circular, however, other shapes are possible by altering the shape of the tear lines 82, 92, for example.

Still referring to FIG. 17, the handle 370 can be separated from the first and second outer top panel sections 40, 50 along the end segments 42*b*, 42*c* of the tear line 42 and the end segments 52*b*, 52*c* of the tear line 52. The first and second top end flaps 342, 352 can be separated from the first and second bottom end flaps 340, 350 and folded upwardly by breaking the bonds formed at the adhesive regions 302, 312.

Turning now to FIGS. 18 and 19, the first and second upper gussets 200, 220 can be detached from the first and second top attachment panels 240, 260, respectively. Similarly, the third and fourth upper gussets 210, 230 can be detached from the third and fourth top attachment panels 250, 270 respectively. Thus, the handle 370 is separated from portions of the first and second upper closure panels 342, 352 (upper gussets 200, 210, 220, 230, 240), thereby allowing the first and second outer top panel sections 40, 50, and the upper gussets 200, 210, 220, 230, 240 to be rotated outwardly towards the respective side panels 20, 30 to provide an open top T exposing all of the interior I and containers C therethrough. The first and second top attachment flaps 280, 300 remain adhesively attached to the flap sections 160*b*, 180*b* of the first and second side end flaps 160, 180, and the third and fourth top attachment flaps 290, 310 remain adhesively attached to the flap sections 170*b*, 190*b* of the third and fourth side end flaps 170, 190. As a result, in the configuration of FIGS. 18 and 19, a cooler 500 for chilling and serving the containers C is formed. The cooler 500 includes a substantially flat first side wall 420, a substantially flat second side wall 430 extending substantially parallel to the first side wall 420, a substantially flat first end wall 440 extending substantially perpendicularly to the first and second side walls 420, 430, a substantially flat second end wall 450 extending substantially parallel to the first end wall 440, the bottom panel 10, and the handle 370 extending between the first and second end walls 440, 450 across the open top T.

The first side wall 420 is formed by the first side panel 20 and the first outer top panel section 40 extending substantially vertically above and substantially coplanar with the first side panel 20. The second side panel 30 and the second outer top panel section 50, which extends substantially vertically above and substantially coplanar with the first side panel 30, constitute the second side wall 430. The first end wall 440 is formed by the first lower end closure flap 340, the first and second side end flaps 160, 180, and a portion of the first upper end closure flap 342 (the first and second upper gussets 200, 220 and the first and second top attachment flaps 260, 280). The first and second upper gussets 200, 220, the flap sections 160*b*, 180*b*, and the first and second top attachment flaps 260, 280 extend substantially vertically above and substantially coplanar with the first lower end closure flap 340 in the first end wall 440. Similarly, the second end wall 450 is formed by the second bottom end flap 350, the third and fourth side end flaps 170, 190 and a portion of the second upper end closure flap 352 (the third and fourth upper gussets 210, 230 and the third and fourth top attachment flaps 290, 310). The third and fourth upper gussets 210, 230, the flap sections 170*b*, 180*b*, and the third and fourth top attachment flaps 290, 310 extend substantially vertically above and substantially coplanar with the second lower end closure flap 350.

The side walls 420, 430 and end walls 440, 450 of the cooler 500 are taller than the side panels 20, 30 and end panels

344, 354 of the carton 400. The interior of the cooler therefore has a depth such that the cooler 500 can be loaded with ice or the like through the open top T for chilling the containers C therein. In order to prevent degradation of the cooler 500 due to the melting of ice contained therein, the inner surface of the blank 1 (FIG. 2), and therefore the inner surfaces of the carton 400/cooler 500, can be coated with a water-proof or water-resistant coating, or my be covered with a water-proof or water-resistant film in a known manner.

Furthermore, the overlapping arrangement of the top panel sections 60, 70 and the attachment of the first and third top attachment panels 240, 250 to the second and fourth top attachment panels 260, 270, respectively, provide the handle 370 with a durable construction. Secure and durable attachment of the handle 370 to the end walls 440, 450 of the cooler 500 is provided by the attachment of the first and second top attachment flaps 280, 300 to the first and second side end flaps 160, 180, and the attachment of the third and fourth top attachment flaps 290, 310 to the third and fourth side end flaps 170, 190.

The containers C illustrated and described herein are cylindrical cans, and are loaded in the carton 400 and cooler 500 in a four-by-five configuration, with each container C resting on its bottom. However, it should be understood that different types of containers can be stored in the carton 400/cooler 500, and different numbers and configurations of containers are possible. Additionally, each of the above described embodiments, which include gussets at the bottom corners that are folded upon forming the carton, are configured to hold liquids, such as water melting from ice used to chill containers C and to keep those liquids from leaking around the gusseted corners. More specifically, these lower gussets ensure that there is a continuous band or strip of paperboard material extending completely around the bottom portion of the cooler that is uninterrupted by discontinuities or glued areas in the paperboard. Employing gussets in this manner is thus useful in keeping water from leaking from the corners of the carton. Further, the interior surfaces of the cooler may be coated with a material that renders the paperboard resistant to absorption of water at least for a reasonable length of time so that water contained in the cooler is not prone to leak through the paperboard during average use.

The foregoing disclosure provides illustrative embodiments of the invention and is not intended to be limiting. As understood by those of skill in the art, the overall invention encompasses other embodiments not specifically enumerated herein. For example, although the carton 400 is shown in the form of a parallelpipedal box, it can alternatively be shaped differently, and likewise the various detachable sections, panel sections, panels and flaps described herein can be shaped and arranged differently.

What is claimed is:

1. A carton for holding containers, wherein the carton is convertible from a first configuration, in which the carton forms a substantially parallelepipedal structure, to a second configuration, in which the carton forms an open-top structure, and wherein:

when the carton is in the first configuration, the carton comprises a first side panel, a second side panel opposite the first side panel, a bottom panel, a top panel comprising a first outer top panel section foldably connected to the first side panel, a second outer top panel section foldably connected to the second side panel, and at least one central top panel section extending between and detachably connected to the first outer top panel section and the second outer top panel section, a first top attachment panel foldably connected to the at least one central top panel section, a second top attachment panel foldably connected to the at least one central top panel section, a first end panel comprising:

a first side end flap foldably connected to the first side panel, a second side end flap foldably connected to the second side panel, and a first upper end closure flap foldably connected to the top panel, the first upper end closure flap comprising:

a first top attachment flap foldably connected to the first top attachment panel and attached to the first and second side end flaps, and a second top attachment flap foldably connected to the second top attachment panel and attached to the first and second side end flaps, wherein the first and second top attachment flaps are attached to opposing sides of the first and second side end flaps, so that the first and second side end flaps are positioned between the first and second top attachment flaps, and a second end panel opposite the first end panel; and when the carton is in the second configuration the at least one central top panel section is detached from the first outer top panel section and the second outer top panel section and forms a handle configured for carrying the carton, the first outer top panel section and the second outer top panel section are folded outwardly to extend upwardly from the first side panel and the second side panel, respectively, thereby forming an open top of the carton, and the handle extends across the open top.

2. The carton of claim 1, wherein, when the carton is in the second configuration, the first outer top panel section and the second outer top panel section are substantially coplanar with the first side panel and the second side panel, respectively.

3. The carton of claim 1, wherein, when the carton is in the first configuration:

the first end panel further comprises a first lower end closure flap foldably connected to the bottom panel, the first upper end closure flap overlapping the first lower end closure flap;

the second end panel comprises a second upper end closure flap foldably connected to the top panel and a second lower end closure flap foldably connected to the bottom panel, the second upper end closure flap overlapping the second lower end closure flap; and the handle has a first end portion in the first upper end closure flap and a second end portion in the second upper end closure flap.

4. The carton of claim 3, wherein, when the carton is in the second configuration:

the first upper end closure flap is detached from the first lower end closure flap and a portion of the first upper end closure flap extends upwardly from the first lower end closure flap; and the second upper end closure flap is detached from the second lower end closure flap and a portion of the second upper end closure flap extends upwardly from the first lower end closure flap.

5. The carton of claim 4, when the carton is in the second configuration, the portion of the first upper end flap and the portion of the second upper end flap are substantially coplanar with the first lower end closure flap and the second lower end closure flap, respectively.

6. The carton of claim 3, wherein, when the carton is in the first configuration:

the first lower end closure flap is attached to a first section of the first side end flap and a first section of the second side end flap; and the second end panel comprises a third side end flap foldably connected to the first side panel, and a fourth side end flap foldably connected to the second side panel, the second lower end closure flap being attached to a first section of the third side end flap and a first section of the fourth side end flap.

7. The carton of claim 6, wherein, when the carton is in the first configuration:

the first upper end closure flap comprises a second section of the first side end flap, a second section of the second side end flap, a first upper gusset, the first upper gusset being foldably connected to the first outer top panel section and the second section of the first side end flap, and the first upper gusset being detachably connected to the first end portion of the handle, and a second upper gusset, the second upper gusset being foldably connected to the second outer top panel section and the second section of the second side end flap, and the second upper gusset being detachably connected to the first end portion of the handle; and the second upper end closure flap comprises a third upper gusset, the third upper gusset being foldably connected to the first outer top panel section and a second section of the third side end flap, and the third upper gusset being detachably connected to the second end portion of the handle, and a fourth upper gusset, the fourth upper gusset being foldably connected to the second outer top panel section and a second section of the second side end flap, and the fourth upper gusset being detachably connected to the second end portion of the handle.

8. The carton of claim 7, wherein, when the carton is in the first configuration:

the at least one central top panel comprises a first central top panel section detachably connected to the first outer top panel section, and a second central top panel section detachably connected to the second outer top panel section, the second central top panel section overlapping the first central top panel section;

the first end portion of the handle comprises the first top attachment panel and the second top attachment panel, and wherein the first top attachment panel is foldably connected to the first central top panel section and detachably connected to the first upper gusset, and wherein the second top attachment panel foldably is connected to the second central top panel section and detachably connected to the second upper gusset, the second top attachment panel overlapping and being attached to the first top attachment panel; and the second end portion of the handle comprises a third top attachment panel foldably connected to the first central top panel section and detachably connected to the third upper gusset, and a fourth top attachment panel foldably connected to the second central top panel section and detachably connected to the fourth upper gusset, the fourth top attachment panel overlapping and being attached to the third top attachment panel.

9. The carton of claim 8, wherein, when the carton is in the first configuration:

the second upper end closure flap comprises a third top attachment flap foldably connected to the third top attachment panel and attached to the third and fourth side end flaps, and a fourth top attachment flap foldably connected to the fourth top attachment panel and attached to the third and second fourth end panels, wherein the third and fourth top attachment flaps are attached to opposing sides of the third and fourth side end flaps.

10. The carton of claim 9, wherein, when the carton is in the second configuration:

the first and second top attachment panels are detached from the first and second upper gussets, respectively;

the third and fourth top attachment panels are detached from the third and fourth upper gussets, respectively;

the first and second upper gussets, the first and second top attachment flaps, and the first and second side end flaps extend upwardly from and substantially coplanar with the lower end closure flap; and the third and fourth upper gussets, the third and fourth top attachment flaps, and the third and fourth side end flaps extend upwardly from and substantially coplanar with the second lower end closure flap.

11. The carton of claim 6, wherein:

the first lower end closure flap comprises a first bottom end panel foldably connected to the bottom panel, a first lower gusset foldably connected to the first side end flap and the first bottom end panel, and a second lower gusset foldably connected to the second side end flap and the first bottom end panel; and the second lower end closure flap comprises a second bottom end panel foldably connected to the bottom panel, a third lower gusset foldably connected to the third side end flap and the second bottom end panel, and a fourth lower gusset foldably connected to the fourth side end flap and the second bottom end panel.

12. The carton of claim 11, wherein:

the first lower end closure flap comprises a first bottom end flap foldably connected to the first bottom end panel and attached to the first and second side end flaps; and the second lower end closure flap comprises a second bottom end flap foldably connected to the second bottom end panel and attached to the third and fourth side end flaps.

13. The carton of claim 1, wherein, when the carton is in the first configuration, the at least one central top panel section comprises:

a first central top panel section detachably connected to the first outer top panel section; and a second central top panel section detachably connected to the second outer top panel section, the second central top panel section overlapping the first central top panel section.

14. The carton of claim 1, wherein:

when the carton is in the first configuration, the top panel comprises:

a first access panel disposed between the at least one central top panel section and the first outer top panel section, and a second access panel disposed between the at least one central top panel section and the second outer top panel section; and the first and second access panels are at least partially detachable from the top panel to provide access to the handle.

15. A blank for forming a carton, the blank comprising:

a first side panel;

a second side panel opposite the first side panel;

a bottom panel;

a first outer top panel section foldably connected to the first side panel;

a second outer top panel section foldably connected to the second side panel;

a first central top panel section connected to the first outer top panel section along a first tear line;

a second central top panel section connected to the second outer top panel section along a second tear line;

a first plurality of panels and flaps configured to form a first end panel of the carton, the first plurality of panels and flaps comprising:

a first side end flap foldably connected to the first side panel;

a second side end flap foldably connected to the second side panel;

a first top attachment panel foldably connected to the first central top panel section;

a second top attachment panel foldably connected to the second central top panel section;

a first top attachment flap foldably connected to the first top attachment panel; and a second top attachment flap foldably connected to the second top attachment panel; and a second plurality of panels and flaps configured to form a second end panel of the carton;

wherein the first and second top attachment flaps are configured to be attached to opposing sides of the first and second side end flaps in the first end panel when the blank is erected to form the carton, and wherein the blank is configured to be erected such that the first and second outer top panel sections and the first and second central top panel sections form a top panel of the carton, the second central top panel section overlaps the first central top panel section in the carton, and the first and second central top panel sections form a handle that is detachable from the first and second outer top panel sections for opening a top of the carton.

16. The blank of claim 15, wherein:

the second plurality of panels and flaps comprises a third top attachment panel foldably connected to the first central top panel section, and a fourth top attachment panel foldably connected to the second central top panel section;

the second top attachment panel is configured to overlap and be attached to the first top attachment panel; and the fourth top attachment panel is configured to overlap and be attached to the third top attachment panel.

17. The blank of claim 16, wherein:

the second plurality of panels and flaps comprises a third side end flap foldably connected to the first side panel, and a fourth side end flap foldably connected to the second side panel.

18. The blank of claim 17, wherein:

the first plurality of panels and flaps comprises a first upper gusset foldably connected to the first outer top panel section and the first side end flap, and a second upper gusset foldably connected to the second outer top panel section and the second side end flap; and the second plurality of panels and flaps comprises a third upper gusset foldably connected to the first outer top panel section and the third side end flap, and a fourth upper gusset foldably connected to the second outer top panel section and the fourth side end flap;

wherein the first upper gusset is detachably connected to the first top attachment flap, the second upper gusset is detachably connected to the second top attachment flap, the third upper gusset is detachably connected to the third top attachment flap, and the fourth upper gusset is detachably connected to the fourth top attachment flap.

19. The blank of claim 18, wherein:

the second plurality of panels and flaps comprises a third top attachment flap foldably connected to the third top attachment panel, and a fourth top attachment flap foldably connected to the fourth top attachment panel; and wherein the third and fourth top attachment flaps are configured to be attached to opposing sides of the third and fourth side end flaps in the second end panel.

20. The blank of claim 18, wherein:

the first plurality of panels and flaps comprises a first bottom end panel foldably connected to the bottom panel, a first lower gusset foldably connected to the first side end flap and the first bottom end panel, a second lower gusset foldably connected to the second side end flap and the first bottom end panel; and the second plurality of panels and flaps comprises a second bottom end panel foldably connected to the bottom panel, a third lower gusset foldably connected to the first side end flap and the second bottom end panel, and a fourth lower gusset foldably connected to the second side end flap and the second bottom end panel.

21. The blank of claim 20, wherein:

the first plurality of panels and flaps comprises a first bottom end flap foldably connected to the first bottom end panel and configured to be attached to the first and second side end flaps; and the second plurality of panels and flaps comprises second bottom end flap foldably connected to the second bottom end panel and configured to be attached to the third and fourth side end flaps.

22. The blank of claim 21, wherein:

the first bottom end panel, the first bottom end flap, and the first and second lower gussets are configured to form a first lower end closure flap in the first end panel;

the first bottom end flap is configured to be attached to a first section of the first side end flap and a first section of the second side end flap;

the first and second top attachment panels, the first and second top attachment flaps, the first and second upper gussets, a second section of the first side end flap, and a second section of the second side end flap are configured to form a first upper end closure flap overlapping the first lower end closure flap in the first end panel;

the second bottom end panel, the second bottom end flap, and the third and fourth lower gussets are configured to form a second lower end closure flap in the second end panel;

the second bottom end flap is configured to be attached to a first section of the third side end flap and a first section of the fourth side end flap; and the third and fourth top attachment panels, the third and fourth top attachment flaps, the third and fourth upper gussets, a second section of the third side end flap, and a second section of the fourth side end flap are configured to form a second upper end closure flap overlapping the second lower end closure flap in the second end panel.

23. The carton of claim 15, comprising:

a first access panel disposed between the first outer top panel section and the first central top panel section; and a second access panel disposed between the second outer top panel section and the second central top panel section;

wherein the first and second access panels are detachable from the top panel in the carton to provide access to the handle.

24. A carton for holding containers, the carton comprising:

a first side panel;

a second side panel opposite the first side panel;

a bottom panel;

a top panel;

a first end panel comprising a first upper end closure flap overlapping a first lower end closure flap, the first upper end closure flap comprising:

a first side end flap foldably connected to the first side panel;

a second side end flap foldably connected to the second side panel;

a first top attachment panel foldably connected to the top panel;

a second top attachment panel foldably connected to the top panel;

a first top attachment flap foldably connected to the first top attachment panel; and a second top attachment flap foldably connected to the second top attachment panel, wherein the first and second top attachment flaps are configured to be attached to opposing sides of the first and second side end flaps;

a second end panel opposite the first end panel, the second end panel comprising a second upper end closure flap overlapping a second lower end closure flap; and a handle extending in the top panel, the handle including a first end portion in the first upper end closure flap and a second end portion in the second upper end closure flap;

wherein the handle is detachable from the top panel, and wherein the first and second end portions of the handle are at least partially detachable from the first and second upper end closure flaps, respectively.

25. The carton of claim 24, wherein the second upper end closure flap comprises:

a third side end flap foldably connected to the first side panel;

a fourth side end flap foldably connected to the second side panel;

a third top attachment panel foldably connected to the top panel;

a fourth top attachment panel foldably connected to the top panel;

a third top attachment flap foldably connected to the third top attachment panel; and a fourth top attachment flap foldably connected to the fourth top attachment panel, wherein the third and fourth top attachment flaps are configured to be attached to opposing sides of the third and fourth side end flaps in the second end panel.

26. A carton for holding containers, the carton comprising:

a first side panel, a second side panel opposite the first side panel, a bottom panel, a top panel comprising a first outer top panel section foldably connected to the first side panel, a second outer top panel section foldably connected to the second side panel, and at least one central top panel section extending between and detachably connected to the first outer top panel section and the second outer top panel section, a first top attachment panel foldably connected to the at least one central top panel section, a second top attachment panel foldably connected to the at least one central top panel section, a first end panel comprising:

a first side end flap foldably connected to the first side panel, a second side end flap foldably connected to the second side panel, a first top attachment flap foldably connected to the first top attachment panel and attached to the first and second side end flaps, and a second top attachment flap foldably connected to the second top attachment panel and attached to the first and second side end flaps, wherein the first and second side end flaps are positioned between the first and second top attachment flaps.

27. The carton of claim 26, wherein the at least one central top panel section comprises:

a first central top panel section detachably connected to the first outer top panel section; and a second central top panel section detachably connected to the second outer top panel section, the second central top panel section overlapping the first central top panel section.

28. The carton of claim 26, wherein:

the top panel comprises:

a first access panel disposed between the at least one central top panel section and the first outer top panel section, and a second access panel disposed between the at least one central top panel section and the second outer top panel section; and the first and second access panels are at least partially detachable from the top panel to provide access to the handle.

29. The carton of claim 26, wherein:

the first end panel further comprises a first lower end closure flap foldably connected to the bottom panel, the first upper end closure flap overlapping the first lower end closure flap;

the carton further comprises a second end panel, and the second end panel comprises a second upper end closure flap foldably connected to the top panel and a second lower end closure flap foldably connected to the bottom panel, the second upper end closure flap overlapping the second lower end closure flap; and the handle has a first end portion in the first upper end closure flap and a second end portion in the second upper end closure flap.

30. The carton of claim 29, wherein:

the first lower end closure flap is attached to a first section of the first side end flap and a first section of the second side end flap; and the second end panel comprises a third side end flap foldably connected to the first side panel, and a fourth side end flap foldably connected to the second side panel, the second lower end closure flap being attached to a first section of the third side end flap and a first section of the fourth side end flap.

31. The carton of claim 30, wherein:

the first upper end closure flap comprises a second section of the first side end flap, a second section of the second side end flap, a first upper gusset, the first upper gusset being foldably connected to the first outer top panel section and the second section of the first side end flap, and the first upper gusset being detachably connected to the first end portion of the handle, and a second upper gusset, the second upper gusset being foldably connected to the second outer top panel section and the second section of the second side end flap, and the second upper gusset being detachably connected to the first end portion of the handle; and the second upper end closure flap comprises a third upper gusset, the third upper gusset being foldably connected to the first outer top panel section and a second section of the third side end flap, and the third upper gusset being detachably connected to the second end portion of the handle, and a fourth upper gusset, the fourth upper gusset being foldably connected to the second outer top panel section and a second section of the second side end flap, and the fourth upper gusset being detachably connected to the second end portion of the handle.

32. The carton of claim 31, wherein:

the at least one central top panel comprises a first central top panel section detachably connected to the first outer top panel section, and a second central top panel section detachably connected to the second outer top panel section, the second central top panel section overlapping the first central top panel section;

the first end portion of the handle comprises the first top attachment panel and the second top attachment panel, and wherein the first top attachment panel is foldably connected to the first central top panel section and detachably connected to the first upper gusset, and wherein the second top attachment panel foldably is connected to the second central top panel section and detachably connected to the second upper gusset, the second top attachment panel overlapping and being attached to the first top attachment panel; and the second end portion of the handle comprises a third top attachment panel foldably connected to the first central top panel section and detachably connected to the third upper gusset, and a fourth top attachment panel foldably connected to the second central top panel section and detachably connected to the fourth upper gusset, the fourth top attachment panel overlapping and being attached to the third top attachment panel.

33. The carton of claim 32, wherein:

the second upper end closure flap comprises a third top attachment flap foldably connected to the third top attachment panel and attached to the third and fourth side end flaps, and a fourth top attachment flap foldably connected to the fourth top attachment panel and attached to the third and second fourth end panels, and the third and fourth top attachment flaps are attached to opposing sides of the third and fourth side end flaps.

34. The carton of claim 30, wherein:

the first lower end closure flap comprises a first bottom end panel foldably connected to the bottom panel, a first lower gusset foldably connected to the first side end flap and the first bottom end panel, and a second lower gusset foldably connected to the second side end flap and the first bottom end panel; and the second lower end closure flap comprises a second bottom end panel foldably connected to the bottom panel, a third lower gusset foldably connected to the third side end flap and the second bottom end panel, and a fourth lower gusset foldably connected to the fourth side end flap and the second bottom end panel.

35. The carton of claim 34, wherein:

the first lower end closure flap comprises a first bottom end flap foldably connected to the first bottom end panel and attached to the first and second side end flaps; and the second lower end closure flap comprises a second bottom end flap foldably connected to the second bottom end panel and attached to the third and fourth side end flaps.

* * * * *